US011644284B2

(12) United States Patent
Bogacz et al.

(10) Patent No.: US 11,644,284 B2
(45) Date of Patent: May 9, 2023

(54) RAPID RESPONSE SELF-DEFENSE SYSTEM AND METHOD

(71) Applicants: Dominik Paul Bogacz, Crystal Lake, IL (US); James T Sorgani, Cary, IL (US)

(72) Inventors: Dominik Paul Bogacz, Crystal Lake, IL (US); James T Sorgani, Cary, IL (US)

( * ) Notice: Subject to any disclaimer, the term of this patent is extended or adjusted under 35 U.S.C. 154(b) by 0 days.

(21) Appl. No.: 17/702,740

(22) Filed: Mar. 23, 2022

(65) Prior Publication Data

US 2023/0040476 A1 Feb. 9, 2023

Related U.S. Application Data

(63) Continuation of application No. 17/140,068, filed on Jan. 2, 2021, now Pat. No. 11,287,225.

(60) Provisional application No. 62/955,425, filed on Dec. 31, 2019, provisional application No. 62/955,415, filed on Dec. 31, 2019.

(51) Int. Cl.
*F41H 9/10* (2006.01)
*B25G 1/10* (2006.01)

(52) U.S. Cl.
CPC ..... *F41H 9/10* (2013.01); *B25G 1/102* (2013.01)

(58) Field of Classification Search
CPC ..... F41H 9/10; G08B 15/02; G08B 15/004
See application file for complete search history.

(56) References Cited

U.S. PATENT DOCUMENTS 3,443,333 A * 5/1969 Manatos ..... F41H 9/10 42/1.08
3,445,046 A * 5/1969 Wilson ..... B65D 83/384 224/148.5
3,602,399 A * 8/1971 Litman ..... F41H 9/10 222/153.11
3,635,372 A * 1/1972 Van Dyck ..... B65D 83/60 222/3
4,092,695 A * 5/1978 Henderson ..... F41B 15/04 231/7
4,223,804 A * 9/1980 Morris ..... F21V 33/0064 222/3
5,177,467 A * 1/1993 Chung-Piao ..... A41D 19/0157 200/DIG. 2

(Continued)

*Primary Examiner* — Joshua E Freeman
(74) *Attorney, Agent, or Firm* — KandareIP, LLC; Anthony Kandare

(57) ABSTRACT

A personal defense device arranged to self-orient and enable accurate aim when gripped by a user is provided. The device has a body including upper and lower regions. The upper region includes a transverse index finger loop, a front portion, a rear portion with a storage cavity for a repellant spray container, a spray opening through the upper region, a thumb support, and a top surface. The top surface is above and perpendicular to the transverse loop, which forms an extended sightline for aiming at a potential target. The lower region includes a grip handle providing multi-finger grip below the index finger transverse loop. The transverse loop, multi-finger grip handle and thumb support self-orient the device in the user's hand, and the top surface sightline enables rapid aiming. The upper region front portion can include a contact feature for defensive contact with an attacker and DNA collection.

20 Claims, 37 Drawing Sheets

(56) References Cited

U.S. PATENT DOCUMENTS 5,242,349 A * 9/1993 Reiff ..... A63B 21/072
222/175
5,318,492 A * 6/1994 Quinn ..... A63B 21/072
222/175
5,392,975 A * 2/1995 Blankenship, Jr. ..... B05B 9/08
206/317
D365,622 S * 12/1995 Edwards ..... D22/117
5,549,220 A * 8/1996 Whalen ..... B05B 9/0805
116/81
5,570,817 A * 11/1996 Anderson ..... F41H 9/10
222/153.11
5,629,679 A * 5/1997 Cranford ..... F41H 9/10
200/519
5,875,945 A * 3/1999 Roach ..... F41H 9/10
224/217

* cited by examiner

SECTION G - G

DETAIL H

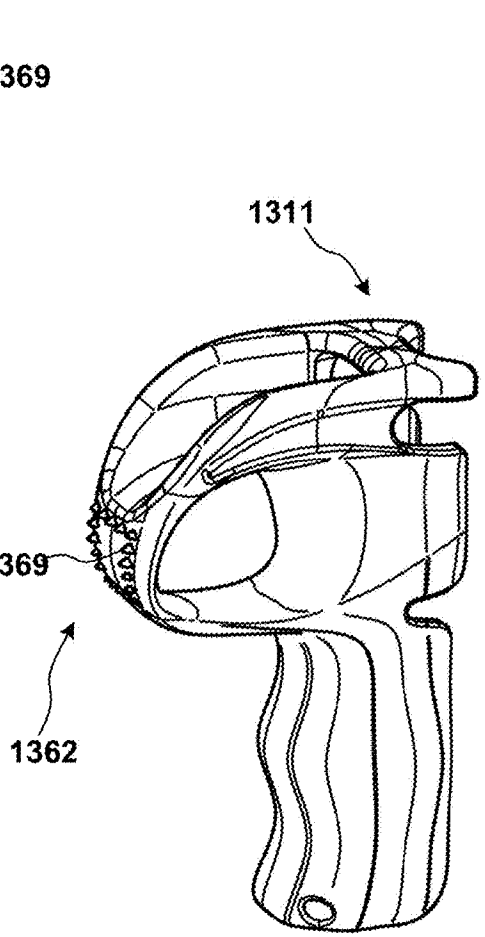
FIG. 68
FIG. 69
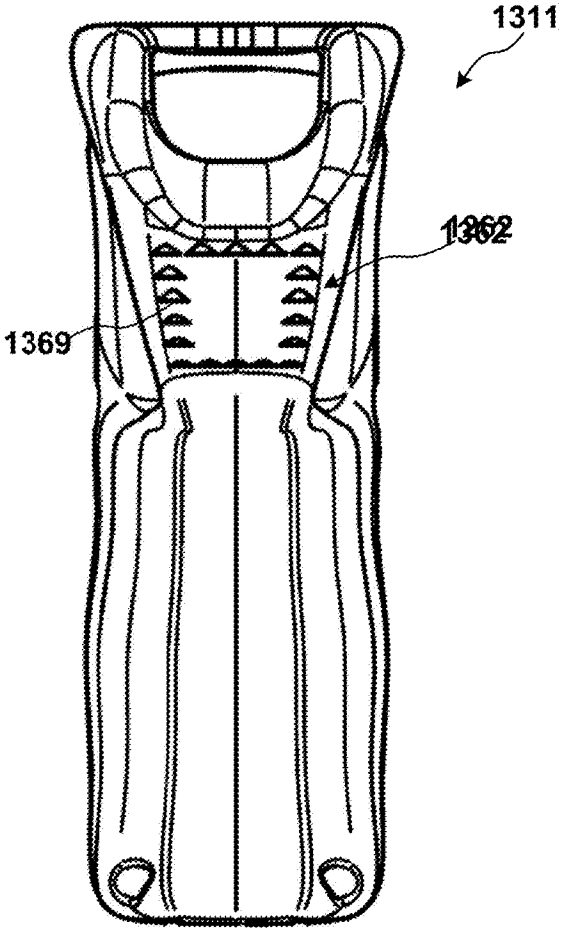
FIG. 67

RAPID RESPONSE SELF-DEFENSE SYSTEM AND METHOD

CROSS-REFERENCES TO RELATED APPLICATIONS

This application is a continuation of U.S. patent application Ser. No. 17/140,068 filed on Jan. 2, 2021 (now U.S. Pat. No. 11,287,225 to Bogacz et al.). Further, this application claims priority to U.S. provisional patent application No. 62/955,415, filed on Dec. 31, 2019, entitled "Repellent Spray Holder with Precision Target Grip, Finger(s) Guard, Stream Protecting Channel and Sharp Spike to Collect the DNA Sample of the Offender"; and also claims priority to U.S. provisional patent application No. 62/955,425, filed on Dec. 31, 2019, entitled "Repellent Spray Holder with Brass Knuckles and Window Glass Breaker." All of the above-listed applications are hereby incorporated by reference.

BACKGROUND

The embodiments described herein relate to personal safety or self-defense devices, and particularly to personal safety or self-defense devices including repellant spray mechanisms and repellant spray holders.

Conventional self-defense devices are known including self-defense devices that include repellant spray mechanisms, which can be highly effective for deterring an attacker or temporarily disabling an attacker and thereby allow a person to escape. However, these self-defense devices include many drawbacks that limit their effectiveness or can delay usage during critical times of need. Some conventional devices include simple handle grips that allow the device to be removed easily from their hands. Further, these simple handle grips can allow the device to be held incorrectly, which can allow the device to easily be misoriented or prevent user activation. As such, the user can spend time struggling to use the device during urgent times of need. Further, these devices allow the user to inadvertently spray themself and become disabled rather than disable the attacker.

Some conventional devices include actuator locks to prevent inadvertent actuation during storage, such as while in a user's purse, or while attempting to grab and hold the device. However, the actuator locks on conventional devices are overly complex and require precious time during an attack to release, such as requiring two finger movements or are designed as an electronic release.

Some conventional devices provide firm grips having multiple finger holes. These devices help ensure proper orientation for usage of the device and make it difficult for an attacker to grab or for the user to drop. However, the multiple finger hole grips of conventional devices are difficult to grab quickly and are particularly challenging to grab quickly without viewing, such as when a user reaches into a purse or pocket to grab while keeping their eyes on a potential attacker.

Some conventional devices include a target guide for aiming a defensive spray at an attacker. These devices are arranged to have the appearance of gun including a barrel from which a spray can be released from the tip. Although these devices may aid with aiming the spray toward an attacker, such devices encourage escalation of violence by providing the appearance of a gun being pointed at the attacker, which encourages the attacker to escalate the level of violence including responding in kind and potentially shooting the user.

Referring now to FIG. 1, U.S. Pat. No. 5,629,679 to Cranford et al. ("Cranford Device"), a conventional self-defense device 10 is shown that generally includes a body 12, an actuation mechanism 40, and a spray mechanism 50. The body 12 has the appearance of gun, which an attacker can mistake for an actual gun. In addition, the body includes a grip 20 having a plurality of finger holes 22 and a self-orientation curvature 30, which can increase the user's grip of the device, reduce the chance of the device being dropped or knocked out of the user's hand, and aid with properly orienting the device and aiming at the attacker. However, the overall shape of the body having a plurality of finger holes provide a design that is difficult for a user to quickly grab and properly orient without looking at the device, which can take precious time during an attack and require the user to take their eyes off of the attacker.

The Cranford Device further includes a spray mechanism 50 having nozzle 52, a trigger 44 located in the index finger hole 22, and a release 42. In order to actuate the device to spray repellant contained within the body, the user must unlock the spray mechanism by moving the release 42 with their thumb prior to pulling the trigger 44 for spraying the attacker. As such, the Cranford Device relies on a two-step, multi-finger operation for unlocking the spray mechanism and actuating the spray, which adds unnecessary multi-finger complexity to its operation and can waste precious time for use of the device during an attack.

Referring now to FIGS. 2 & 3, U.S. Pat. No. 3,443,333 to Manatos ("Manatos Device") describes a self-defense device 10' having a body 12', an actuation mechanism 40', and a spray mechanism 50'. The body 12' is formed as small palm pistol that includes a grip 20' having a plurality of finger holes 22' extending laterally from a side of the body. The lateral finger hole arrangement can increase the user's grip of the device, reduce the chance of the device being dropped or knocked out of the user's hand, and aid with properly orienting the device and aiming at the attacker. However, the overall shape of the body having a plurality of finger holes provide a design that is difficult for a user to quickly grab and properly orient without looking at the device, which can take precious time during an attack and require the user to take their eyes off of the attacker.

The Manatos Device further includes a spray mechanism 50' having nozzle 52', a thumb trigger 44' located at a top portion of the body 12', and a release 42' located proximate the thumb trigger on an opposite lateral side of the body. In order to actuate the device to spray repellant contained within the body, the user must unlock the spray mechanism by moving the release 42' with their thumb prior to pressing the thumb trigger 44' for spraying the attacker. As such, the Manatos Device relies on a two-step, multi-planar operation of the thumb unlocking the spray mechanism and actuating the spray, which adds unnecessary complexity to its operation and can waste precious time for use of the device during an attack.

Referring now to FIG. 4, WO2014/131050 to Laser Energetics, Inc. ("Laser Energetics Device"), another conventional self-defense device 10" is shown that generally includes a body 12", an actuation mechanism 40", and a spray mechanism 50". The body 12" is shaped generally as a rectangle having a longitudinal axis<L, which includes a grip 20" having an overall finger opening 21" at a center portion of the body oriented parallel with the longitudinal axis<L, a plurality of finger contours 23" formed within the overall finger opening 21", and a plurality of spike 62". The shape of the body 12", overall finger opening 21", and plurality of finger contours 23" can increase the user's grip of the device, reduce the chance of the device being dropped or knocked out of the user's hand, and aid with properly orienting the device and aiming at the attacker. However, the rectangular design centered about the overall finger opening provides a design that is difficult for a user to quickly grab and properly orient without looking at the device or until encountering spikes 62" against the user's palm, which can take precious time during an attack and require the user to take their eyes off of the attacker.

The Laser Energetics Device further includes a spray mechanism 50" having nozzle 52", a trigger 42" located in the index finger hole contour 23", and a release 44". In order to actuate the device to spray repellant contained within the body, the user must electronically actuate the device via release 42" with their thumb prior to pulling the trigger 44" for spraying the attacker. As such, the Laser Energetics Device relies on a two-step, multi-finger operation for unlocking the spray mechanism and actuating the spray along with waiting for the electronic system to unlock the trigger, which adds unnecessary multi-finger complexity to its operation and can waste precious time for use of the device during an attack. Further, the Laser Energetics Device includes multiple supplemental functions, which add further complexity for operation of the device, which can delay its usage for releasing a repellant spray during the critical period of an attack.

Thus, a need exists for overcoming drawbacks and limitations of conventional safety or self-defense mechanisms and devices including repellant spray mechanisms. Further, a need exists for a rapid response self-defense device that a user can readily and firmly grab in a proper orientation and easily activate for effective use without risk of blocking the spray or self-spray.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

One general aspect includes a self-orienting, rapid-response personal self-defense device having an elongate body, a spray opening, a stream channel, an orientation guide, and a contoured grip. The elongate body has a body wall, a top surface portion, a front region, and a pair of lateral regions. An outer surface portion of the body wall extends about the front and lateral regions, and an opposite inner surface portion of the body wall defines an elongate storage cavity within the body configured to retain an elongate repellant container. The spray opening is defined through the body wall from the storage cavity to the top surface portion.

The stream channel is formed at the top surface portion extending from the spray opening to a front end of the spray channel, and the stream channel is oriented in a forward direction aimed at a potential target when in a use condition gripped by a user. The orientation guide is formed in an upper region of the body having a tip portion pointing in the forward direction aimed at the potential target in the use condition gripped by the user, and defines an index finger orientation surface. The orientation surface faces downward in the use condition when gripped by the user, and the orientation surface is configured for readily identifying to the user an intended grip location and device orientation based on contact between the user's index finger with the orientation surface.

The contoured grip is formed between a rear region of the device and the outer surface portion, which has a grip diameter sized for the user. The orientation surface and the contoured grip are configured for rapid self-orientation of the personal self-defense device when grabbed by the user.

Other safety and self-defense devices, related systems, components and/or methods according to aspects and features pertaining to inventive concepts described herein will be or become apparent to one with skill in the art upon review of the following drawings and detailed description. It is intended that all such additional devices, related components, systems, and/or methods included within this description be within the scope of this disclosure.

BRIEF DESCRIPTION OF THE DRAWINGS

FIGS. 60 to 69 are perspective views of a further example rapid response self-defense and repellant spray device in accordance with aspects and features of inventive concepts shown and described herein including a further option for a DNA collector.

DETAILED DESCRIPTION

Figure 2:
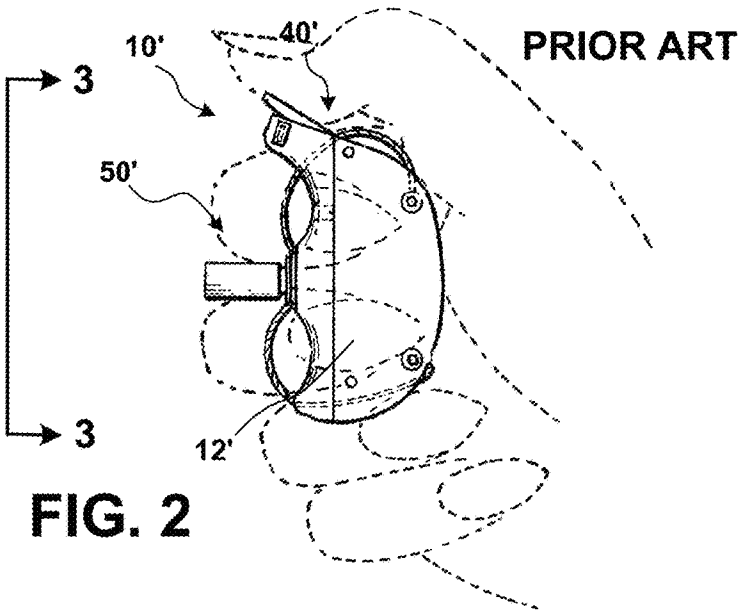
FIG. 2 is a side view of a conventional PRIOR ART repellant spray device having a pair of lateral finger loops and a thumb-activated spray mechanism.
Figure 3:
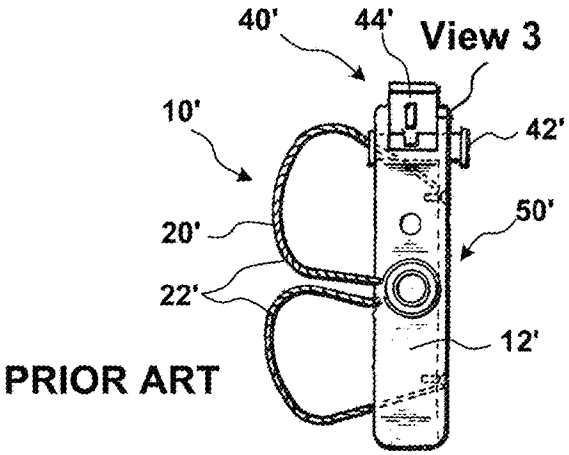
FIG. 3 is a front view of the conventional PRIOR ART repellant spray device of FIG. 2.
Figure 1:
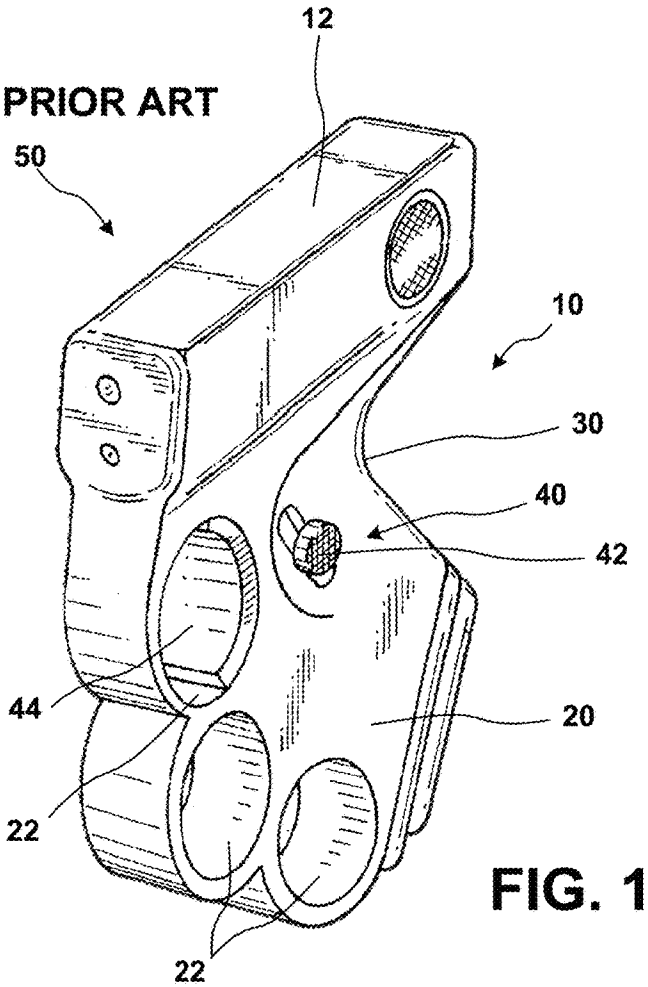
FIG. 1 is a perspective view of a conventional PRIOR ART self-defense repellant spray device having an integrated brass knuckles type grip.
Figure 4:
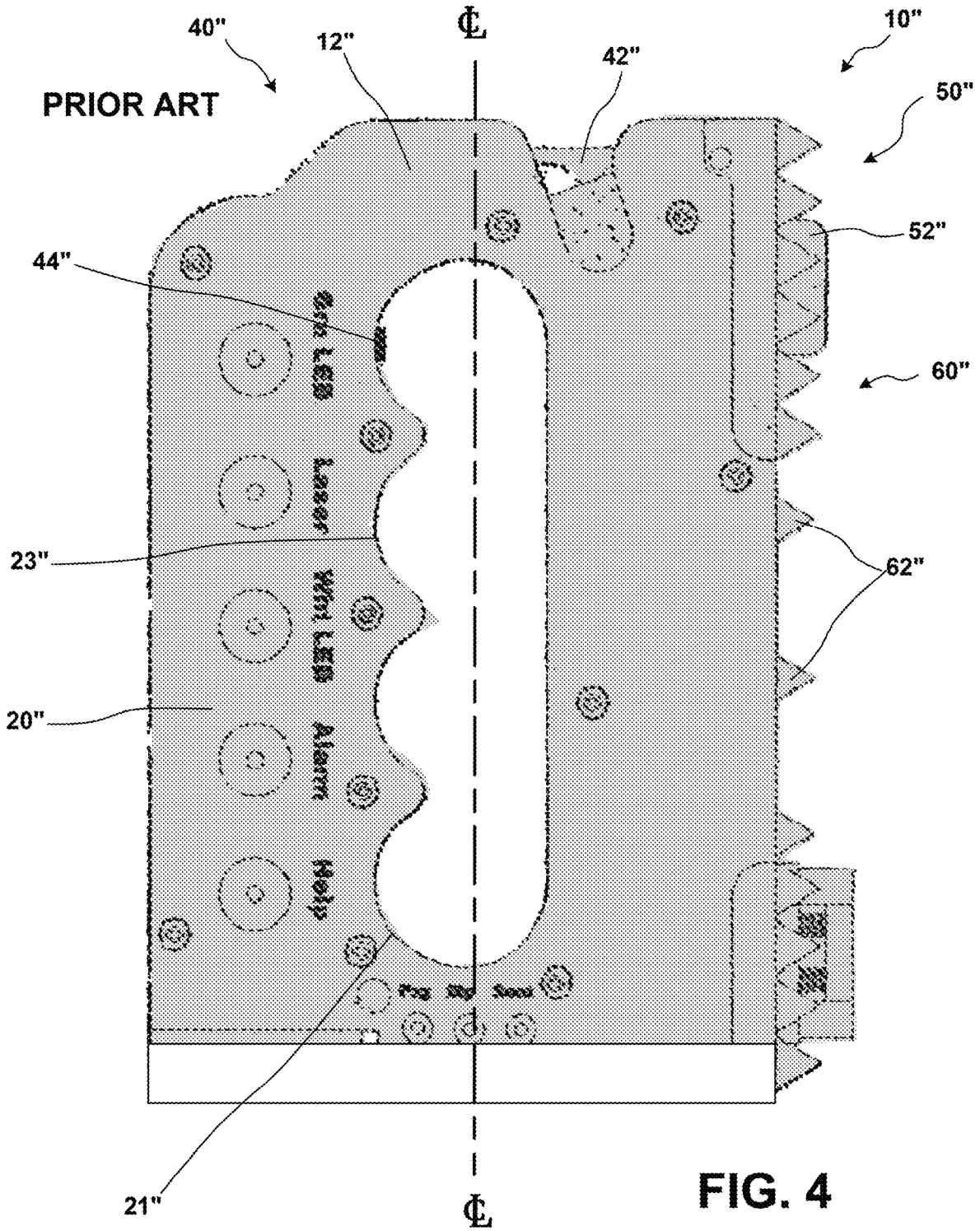
FIG. 4 is a side view of a conventional PRIOR ART safety and self-defense device having multiple features including a multi-finger grip, a repellant spray, and offensive contacts at a forward section that can capture DNA of an attacker.

For the purposes of promoting an understanding of the aspects, features and principles pertaining to the invention and configurations discussed herein, reference will now be made to the example configurations and arrangements illustrated in the drawings along with language describing the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly, or explicitly.

Further, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the words "top," "above," and "upward" refer to elevation directions pertaining to self-defense device orientations when held generally vertically by a user for typical usage of such devices. As such, the words "bottom," "below," "base" and "downward" refer to elevation directions at or towards the ground when self-defense repellant devices are held by a user in substantially vertical orientation. Thus, for example, the top portion of example self-defense devices would be disposed at a distal end of the device farthest from the ground, and the opposite end would be disposed at a proximal base or bottom end of the device.

Further, specific words chosen to describe one or more embodiments and optional elements or features are not intended to limit the invention. For example, spatially relative terms—such as "beneath," "below," "lower," "above," "upper," "proximal," "distal," and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures were turned over, elements described as "below" or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes include various spatial device positions and orientations.

Similarly, geometric terms, such as "parallel," "perpendicular," "round," "curvilinear," "articulated" or "square," are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a," "an," and "the" are intended to include the plural forms as well, unless the context indicates otherwise. The terms "comprises," "includes," "has," and the like specify the presence of stated features, steps, operations, elements, components, etc., but do not preclude the presence or addition of one or more other features, steps, operations, elements, components, or groups.

Unless indicated otherwise, the terms exercise apparatus, device, equipment, systems, and variants thereof, can be interchangeably used.

According to aspects and features pertaining to embodiments described herein, revolutionary repellent spray self-defense device configurations and arrangements are provided having multiple highly beneficial features in various combinations, which can include features such as a precision target grip, finger(s) guard, a stream protecting channel, DNA collector(s), and defensive features like a sharp attacker-oriented spike.

Further, combinations of aspects and features can cooperate to self-orient the device accurately and quickly in the user's hand for immediate use with the nozzle directed away and toward an attacker in a use pose.

Further, beneficial features such as an ergonomic shape, power grip arrangement, orientating finger guard, and a stream protecting channel can prevent a user's finger from inadvertently blocking a spray stream, as well as reducing or eliminating risk of self-spray or blow-back. Defensive feature options can include arrangements having one or more fused-in metallic or non-metallic shapes configured to deter an attacker during contact, such as through pain or extreme discomfort when the attacker contacts the device held by the user. In some arrangements, the shape can be arranged as a spike or other force-concentrating shape. Further, such defensive shapes can provide additional benefits including also acting as a DNA collector configured for obtaining and collecting DNA samples from the offender during self-defensive contact, which can significantly aid appropriate authorities to identify, locate and take appropriate actions. It is understood that the shape of a spike is one option and that many other shapes can be used.

A repellent spray compartment portion can include a repellent spray anti-rotating boss that can ensure proper orientation of the repellent spray inside the housing. The repellent spray compartment can further include one or more side relief slots that allow for rotating a repellent spray's trigger to lock it if not used to prevent accidental discharge, and allow for ready rotation of the trigger to the usage position.

The holder or body can include a hole for attaching a wrist strap to secure the repellent spray holder to the wrist. The holder can also include retention features for firmly securing the repellent spray container in place, while allowing for removal and replacement of the repellent spray container without damaging the holder or the repellent spray container. The ergonomic design and comfortable fit of the body and handle can allow for continuous holding in hand during physical activities, such as running, walking, rollerblading, etc. The holder can be made out of various metallic and nonmetallic materials, and can be made in many different colors and appearances.

In some configurations, the body or repellant holder can mimic the shape of the letter "P," which can help indicate a purpose of the device as a Pepper Spray Holder and/or to indicate "protection" or "protective device." The "P" shape configuration can provide the user with a confidence similar to that of holding the gun without having a gun shape, provoking an offender or attacker, or escalating a level of violence.

Further, the body or repellant spray holder can be produced with a guard for a single or multiple fingers, but is not limited to these shapes only. Optionally, the body or holder can be made without having a finger guard while including a stream protecting channel. Moreover, the holder can be produced in different sizes that can be customized for the user and size of the hand, and/or to fit with different types of repellent spray containers.

In addition, the body or holder and/or a wrist strap can include a logo or other representation of a person, entity or organization including a logo representing a school, college, university, and/or corresponding team logo, as well as names. The representations can be produced in assorted colors and have embedded letters, symbols, and logos of these institutions including having a raised symbol or embedded symbol formed in the body. Optionally, the holder can have the initials of the owner or other representation embedded therein.

In some configurations, the self-defense device can include personal safety device in combination with a personal defense weapon, such as a repellant spray holder in combination with a glass window breaker and reinforced finger openings configured with brass-knuckle type components. The finger openings can include one or reinforcement bridges between finger opening, as well as one or more DNA collectors and/or metallic or non-metallic fused-in spikes. Alternatively, the DNA collectors and/or spikes can be configured as selectively replaceable components, such that the user can screw in and out DNA collector and defensive protection spikes and other features as desired.

In some configurations, the elongate storage cavity can be configured to generally form a tube for retaining a repellant spray container. A removable plug can lock the repellant spray container within the tubular storage cavity along with providing dual window breaking functionality. A hard sharp point insert can be embedded into the plug and extend downward while held by the user, which can be configured to concentrate forces at the hard point for breaking a glass windows during an emergency. The plug can include removable latch-type features for secure retention of the repellant container along with providing for ready replacement of the container. In some arrangements, the removable latch-type features can be configured as spring-loaded latches. The plug, body and other components of the self-defense device can be made out of various metallic and nonmetallic materials and can also be made in many different colors and appearances.

Referring now to FIGS. 5A to 24, an example self-orienting, rapid-response personal self-defense device 110 is generally shown according to aspects and preferences pertaining to inventive concepts described herein for self-defense devices. Self-defense device 110 generally includes an elongate body 111 configured to receive a spray repellant container 174. The elongate body generally includes a body wall 112, a top surface portion 113, a front region 114, and a pair of lateral regions 115, in which an outer surface portion 116 of the body wall 112 extending about the front region 114 and lateral regions 115. An opposite inner surface portion 117 of the body wall 112 defines an elongate storage cavity 118 within the body configured to retain an elongate repellant container 174 having a trigger 175 and a nozzle or sprayer 152. A spray opening is defined through the body wall 112 from the storage cavity 118 to the top surface portion 113.

The self-defense device 110 and body 111 form a stream channel 154 formed at the top surface portion 113 extending from the spray opening 152 to a front end of the stream channel. The stream channel 154 is oriented in a forward direction aimed at a potential target when in a use condition gripped by a user. Further, an orientation guide 130 is formed in the upper region of the body 111 having a tip portion 132 pointing in the forward direction aimed at the potential target in the use condition gripped by the user and defining an index finger orientation surface 134, in which the orientation surface faces downward in the use condition when gripped by the user. The orientation surface 134 is configured for readily identifying to the user an intended grip location and device orientation based on contact between the user's index finger with the orientation surface. As such, the orientation guide 130, the orientation surface 134 and other features readily identify to the user simply by feel the proper grip and orientation for grabbing and using the self-defense device 110.

Figure 15:
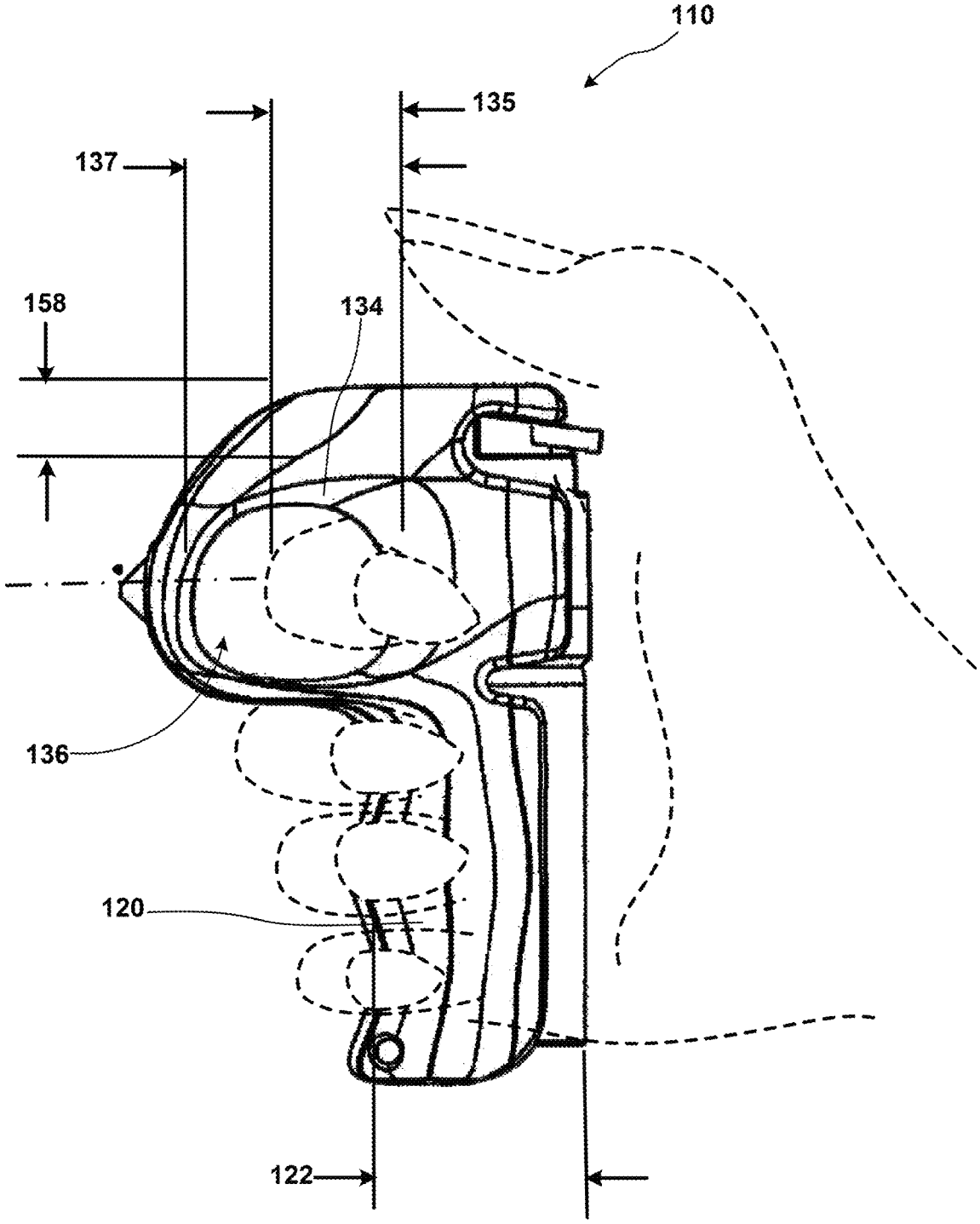
FIG. 15 is a side elevation view of the example self-defense device of FIG. 5A shown in a schematic rapid response grip example held by a user.
Figure 16:
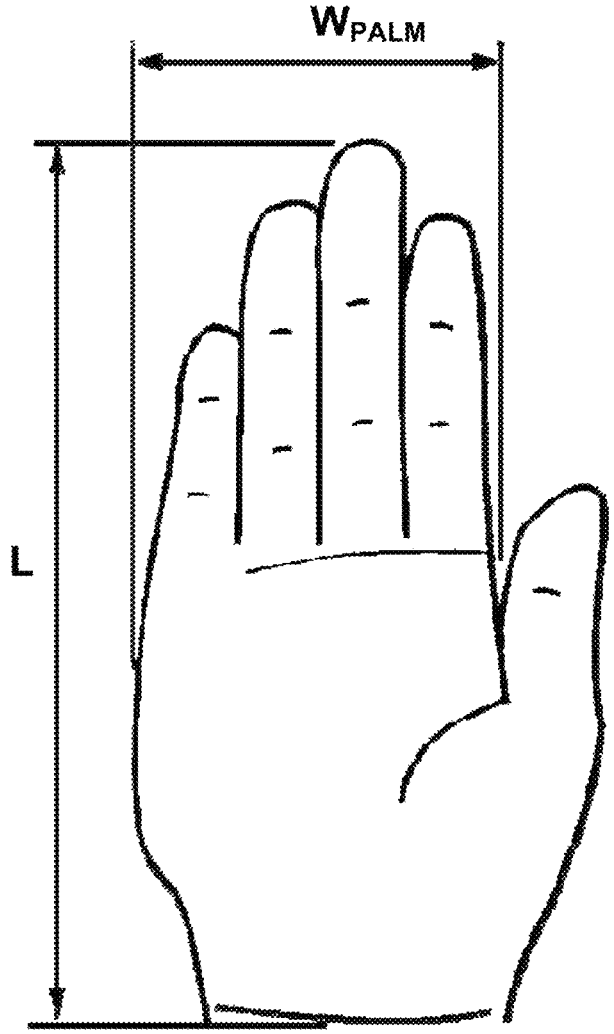
FIGS. 16 and 17 illustrate hand measurements for determining a firm grip diameter for a user of the self-defense device of FIG. 5A.
Figure 17:
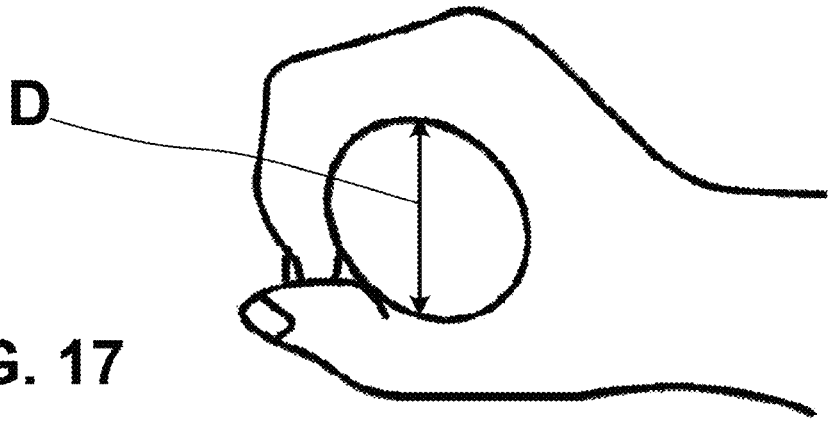

In addition, a secure contoured grip 120 is formed between a rear region of the device and the assembly with the repellant spray container 174 with the outer surface portion, which has a grip diameter sized for the user as shown and described along with FIGS. 15-17. The orientation guide can define a single finger opening 136 extending laterally through the orientation guide 130 without defining additional finger openings. The arrangement of a single finger opening 136, and further a slightly oversize, contoured single finger opening enhances the user's ability to quickly identify through feel alone the proper orientation for the self-defense device 110 and securely grip the device 110 for rapid usage in the proper orientation. The single finger opening can be configured to receive the user's index finger, in which the upper inner surface of the finger opening forms the orientation surface 134 noted above. Further, the single finger opening can form a closed loop for enhanced retention of the device during use, and can include a finger contour 138 formed in the outer surface portion below the orientation guide. Although such an arrangement of single finger opening can provide benefits for rapid orientation and firm gripping of the device 110, it is understood that other device configurations can include different finger opening arrangements as discussed below.

As can be seen in FIG. 15 along with FIGS. 16 and 17, the self-defense device 110 can be sized for the user, such that the single finger opening 136 defines an inside diameter that is oversized for an index finger of the user without being overly large. The oversized inside diameter can be configured to enhance rapid self-orienting and firm gripping of the personal self-defense device by the user particularly when combined with a contour 138 formed within the opening and along lateral portions proximate the opening. The inside diameter, when measured in a substantially horizontal direction in a use configuration when gripped by a user, can be about 1.25 to 2 times the user's index finger diameter. Further, the inside diameter can be about 1.5 times the user's index finger diameter, which can enhance quick gripping and orienting of the device for use. In addition, when sized to have a diameter less than 2 times the user's index finger diameter, the finger opening 136 can provide for secure retention of the device during usage. Further, when sized to be less than 1.75 times the user's index finger diameter secure retention can be further enhanced. Thus, a diameter between 1.25 and 1.75 times the user's finger diameter, and about 1.5 times the user's finger diameter, can provide for quick gripping, proper orientation, and firm gripping of the device 110 by a user.

Figure 5A:
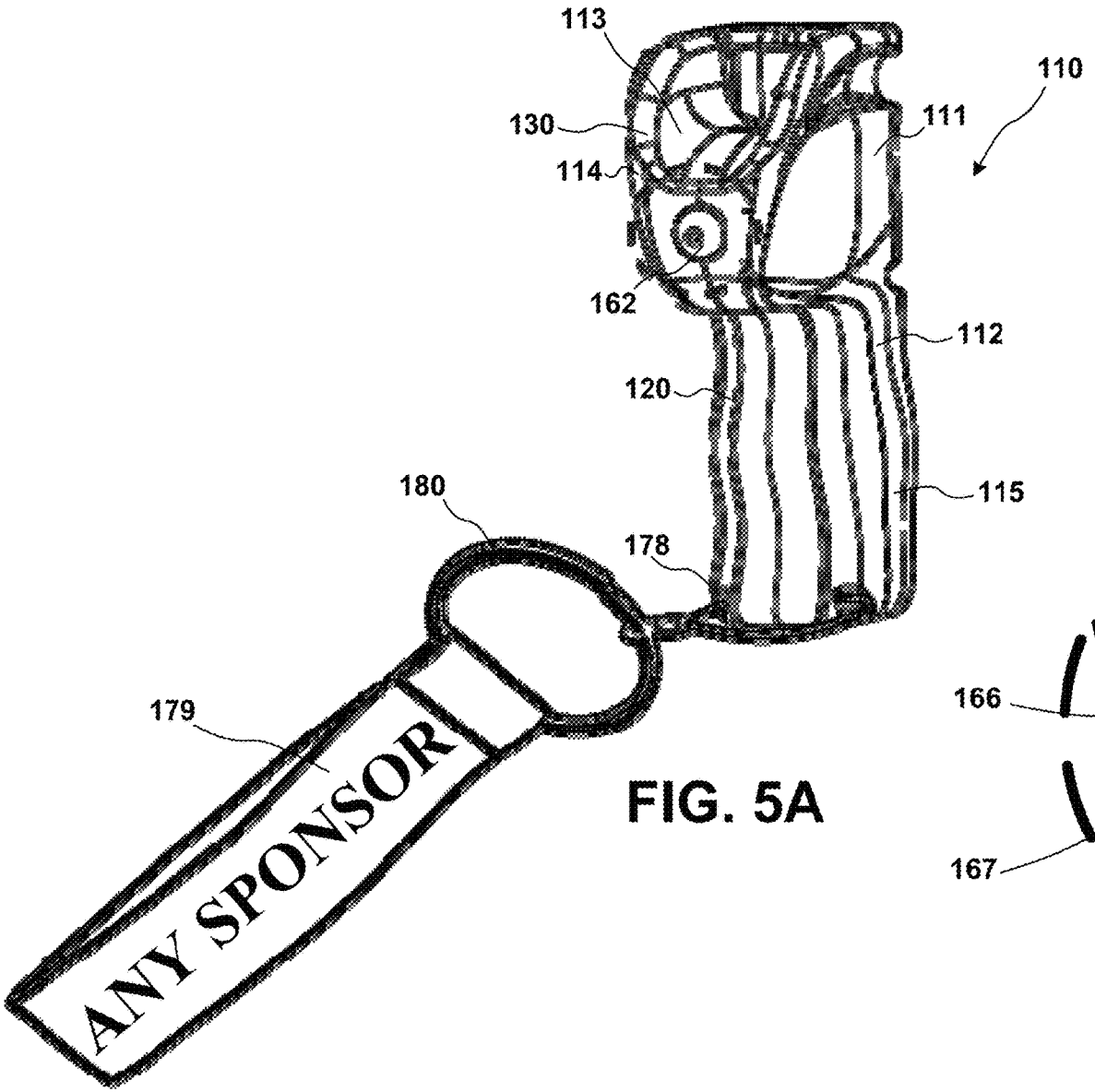
FIG. 5A is a perspective view of an example rapid response self-defense and repellant spray device in accordance with aspects and features of inventive concepts shown and described herein.
Figure 5B:
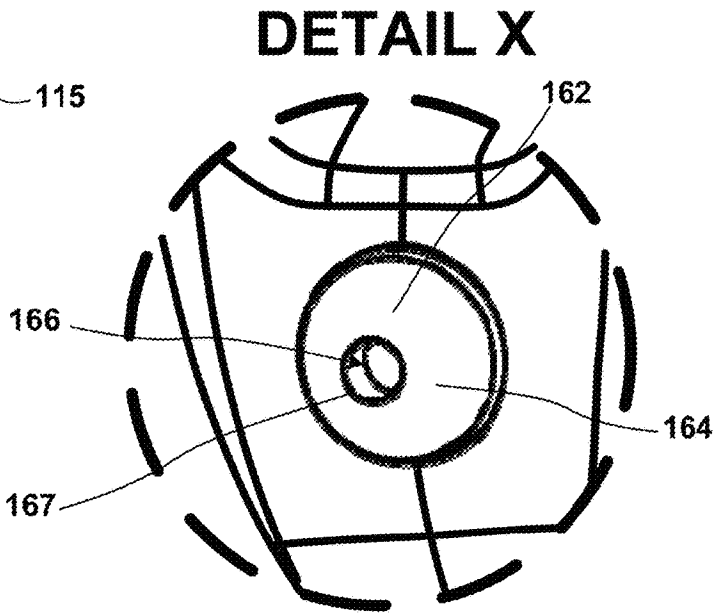
FIG. 5B is a detail view of an example DNA collector located at a front portion of the self-defense device of FIG. 5A as indicated in FIG. 5A.

As can be seen in FIGS. 5A and 5B, the self-defense device 100 can include an attacker contact 160 attached to the tip portion 132 in the form of a DNA collector 162. The DNA collector can have an outer surface configured to provide a defensive contact with an attacker and collect a DNA sample from the attacker during the defensive contact. In some configurations, the DNA collector 162 can include a curved shape that defines a dimple 162 within the curved shape. In addition, the DNA collector 162 can include a rim portion 167 defining a sharp collection edge configured to scrape the DNA sample from the attacked during the defensive contact. In some configurations, the dimple can form a closed recess for retaining collected DNA samples. In other configurations shown and discussed below, the dimple can be formed as a through-hole to maximize retaining capacity.

Although a single DNA collector is shown for device 110 in the example form shown, it is understood that various types of DNA collector devices can be included in various forms, such as various textures configured to scrape the DNA sample from the attacker during the defensive contact. For example, DNA collectors can include textures such as the tip portion having a knurled surface, a milled surface, a grooved surface, a furrowed surface, a roughened surface, a raised projections surface, and an irregular projections surface.

As can be seen in FIGS. 19, 20, 23 and 24, the stream channel 154 can include a base surface 155 oriented in the forward direction aimed at the potential target when in the use condition gripper by the user, in which the base surface is disposed at or below a lower part of the stream opening 153. The stream channel 154 can further include a pair of opposed side surfaces 156 aligned with the base surface 155 and spaced apart on each side of the base surface, which extend upward from the base surface. As shown, the base surface 155 and the upward extending side surfaces 156 define the stream channel 154 in one configuration as an open top recessed channel. Such a configuration can accurately channel and direct the spray toward the user while reducing opportunities for blow back toward the user. Further, a hood 125 across a rear portion of the channel prevents the user from inadvertently overextending their thumb while depressing the trigger 175 and blocking a portion of the spray.

The base surface 155 can have an increasing downward slope in the forward direction from the spray opening toward the distal end of the spray channel, and the pair of opposed side surfaces 156 can have outboard diverging curvatures extending upward from the base surface. These features can cooperate to provide a focused stream aimed at the potential attacker while preventing back spray to the user, which can further act as an aim or target guide 130 for the user along with the tip portion 132 to enable accurately aiming the spray at an offender or attacker.

As can be seen, for example, in FIGS. 10A, 10B, 18 and 19, the inner surface portion 117 can define an inner cylindrical shape for the storage cavity 118 that corresponds with an external shape of the repellant container 174. The storage cavity 118 can be formed as an elongate opening defined in the rear region oriented parallel with the elongate orientation of the body, which provides access into the cylindrical shaped storage cavity. One or more pairs of flexible retention arms 119 can be formed at the rear region that define edge portions of the elongate opening, in which each pair of the flexible retention arms can be curved to extend about rear portions of the repellant container 174, and can be configured to flex outward for providing the access and biased to a retention position for securely retaining the repellant container. The pair or pairs of flexible retention arms 119 can be configured to provide snap-in insertion and removal of the repellant container, and the use of two or more pairs of flexible retention arms can make it easier for a user to snap the repellant container in and out for replacement.

A bottom support boss 123 can extend across a lower region of the storage cavity that has an engagement surface at an upper side oriented upward into the storage cavity, which can engage a base or bottom portion 177 of the repellant container 174 to further secure retention of the repellant container. Further, the body 111 can include an anti-rotation boss 151 at an upper portion of the storage cavity 118, which can be configured to mate with lateral anti-rotation surfaces 173 of the repellant spray container (FIG. 8) for preventing rotation of the repellent spray container while retained in the storage cavity 118.

Figure 14:
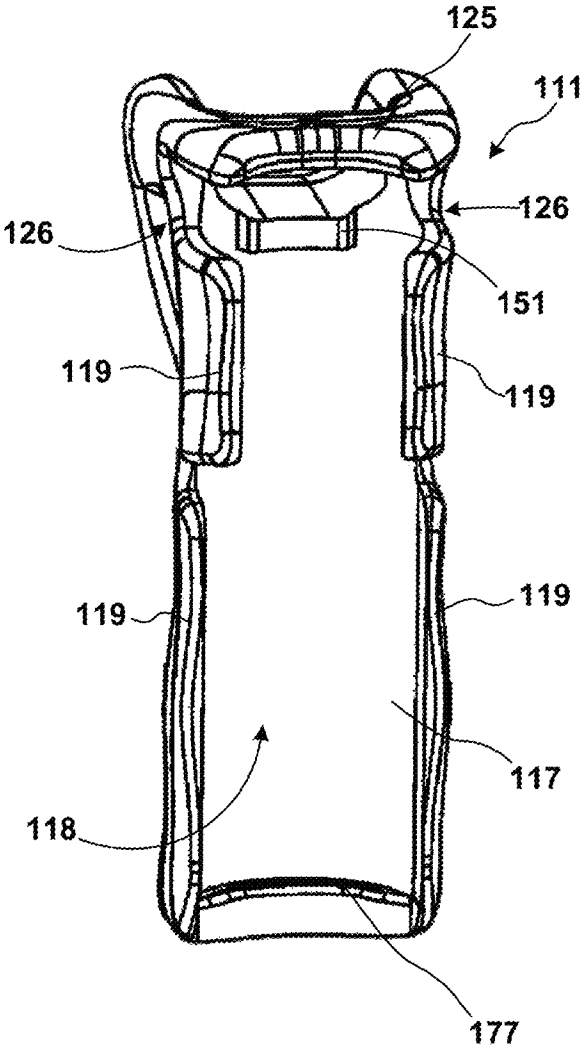
FIG. 14 is a rear elevation view of the same.
Figure 13:
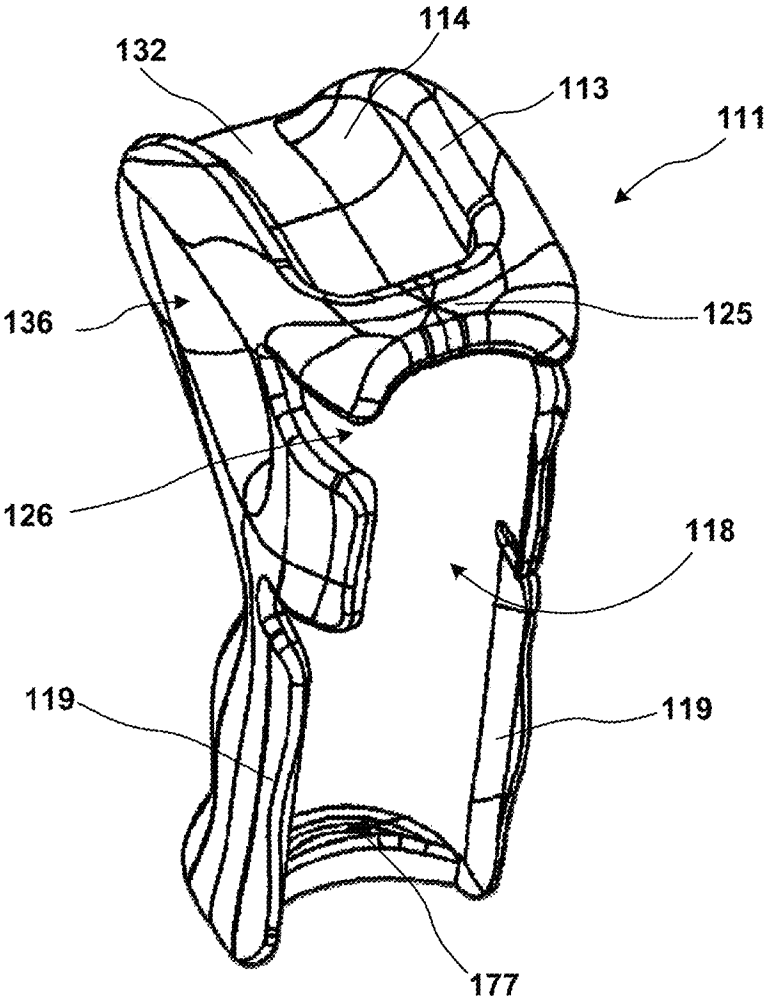
FIG. 13 is an upper rear perspective view of the body of FIG. 10A.
Figure 19:
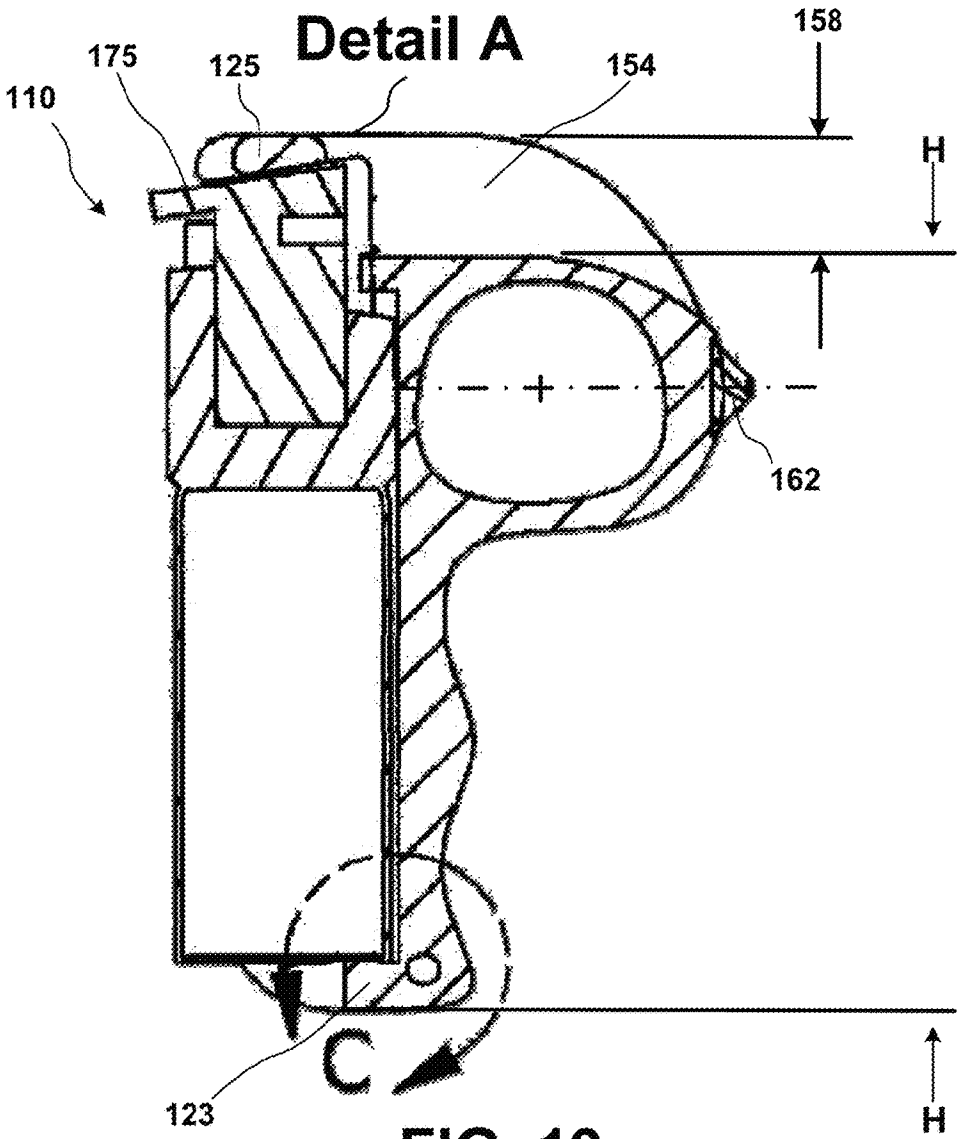
FIG. 19 is a side cross-sectional view denoted as View A-A according to Line A-A shown in FIG. 18 of the self-defense device of FIG. 5A, which shows curved Line C-C indicating the lower attachment region of Detail View C of FIG. 22.
Figure 18:
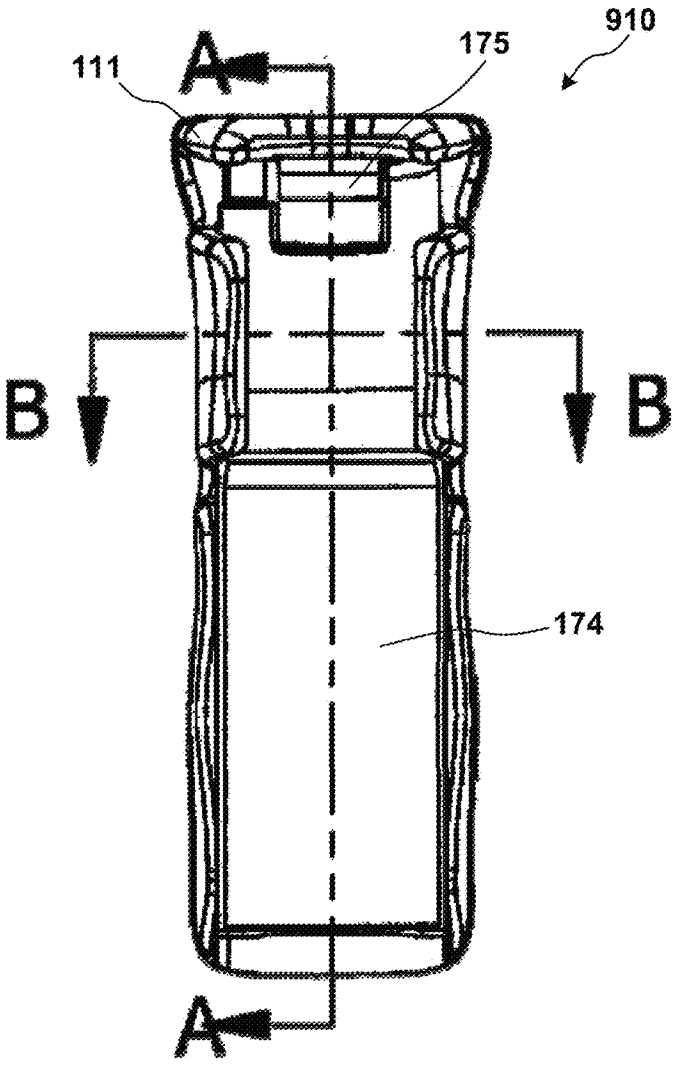
FIG. 18 is a rear elevation view of the example self-defense device of FIG. 5A showing Line A-A and Line B-B indicating top and side cross-sectional view orientations corresponding with FIGS. 19 and 21 respectively.
Figure 20:
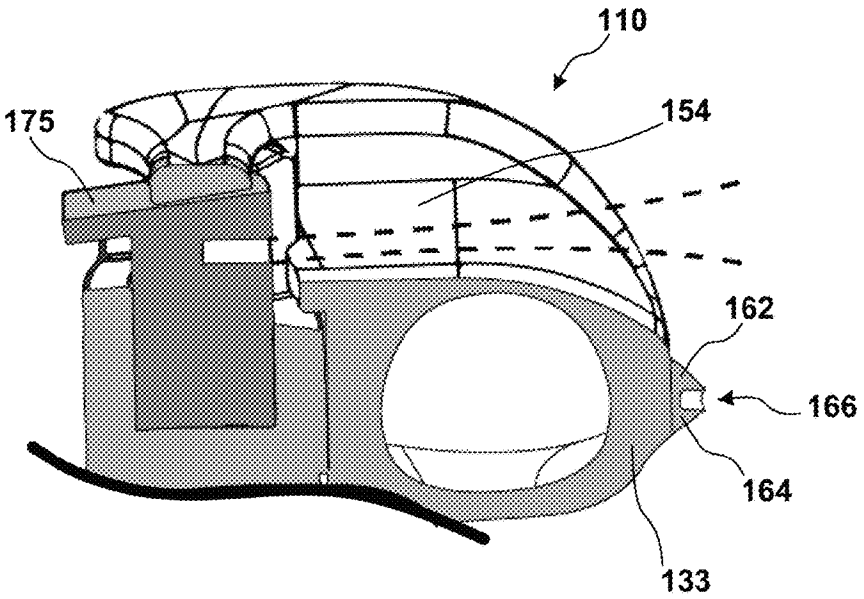
FIG. 20 shows a portion of the side cross-sectional view of FIG. 19 illustrating an example spray stream and showing an optional arrangement for the DNA collector.
Figure 21:
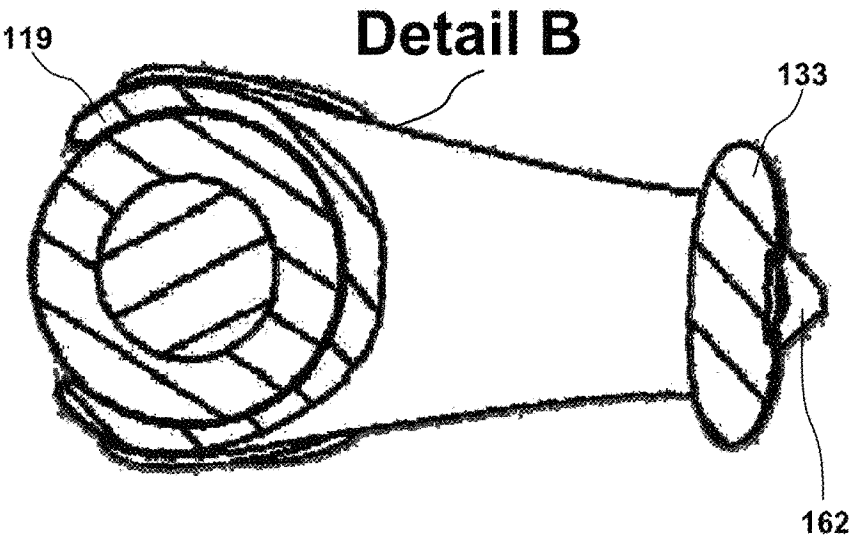
FIG. 21 is a cross-sectional view from above denoted as Detail View B according to Line B-B shown in FIG. 18 of the self-defense device of FIG. 5A.
Figure 23:
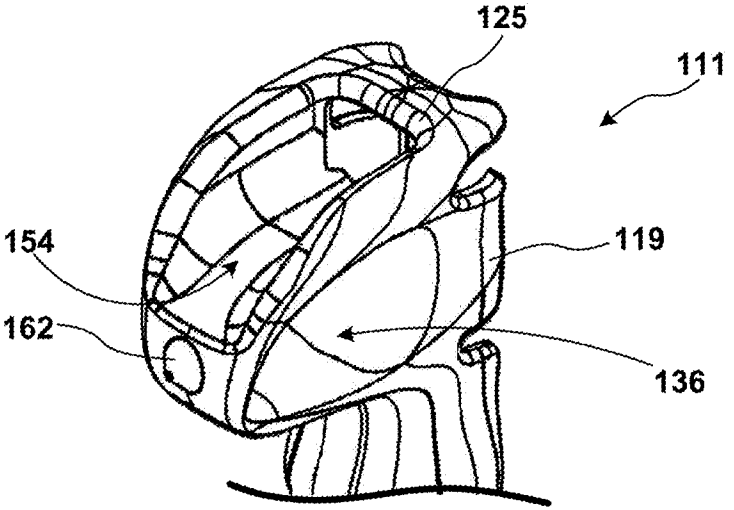
FIGS. 23 and 24 are partial perspective views of the body of FIG. 10A highlighting the example shaped, user-protected spray channel of self-defense device of FIG. 5A.
Figure 24:
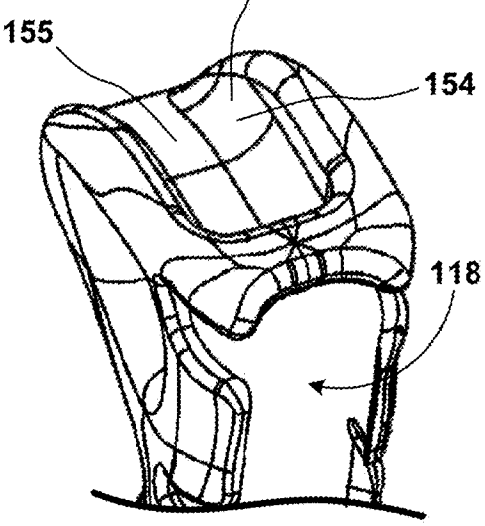
Figure 22:
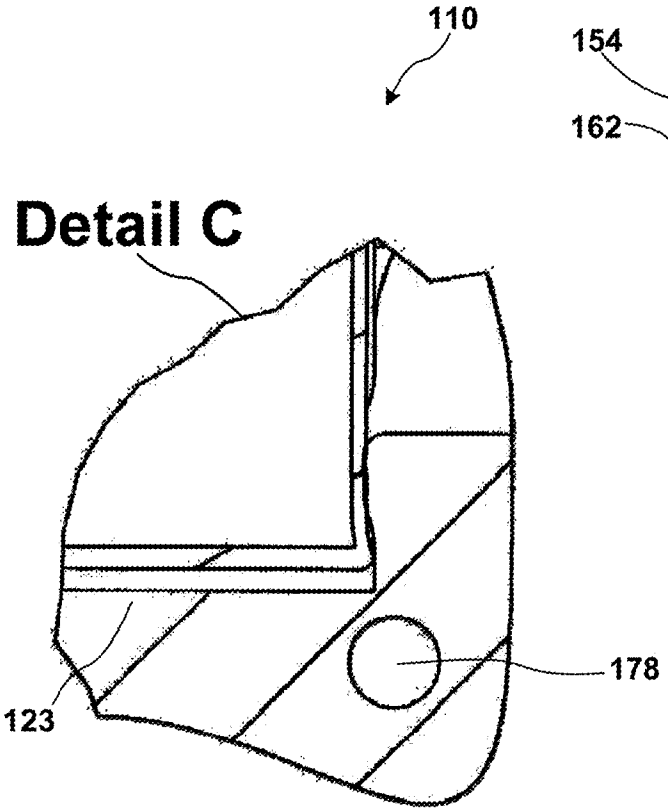
FIG. 22 is a Detail View C of a lower attachment region according to Line C-C shown in FIG. 19 of the self-defense device of FIG. 5A.

As can be seen in FIGS. 13 and 14 along with FIGS. 18 and 19, the body 111 can define one or more side relief slots 126 at either or both side portions of the trigger 175. The relief slot or slots 126 can be configured to receive rotation of the trigger of the repellant container to prevent accidental discharge of repellant spray while the trigger is disposed within the at least one side relief slot. Further, such an arrangement allows the user to quickly and easily rotate the trigger to the center location with their thumb for activation. Such an arrangement can permit the user to rotate and depress the trigger in essentially a single slide and depress motion.

Figure 7:
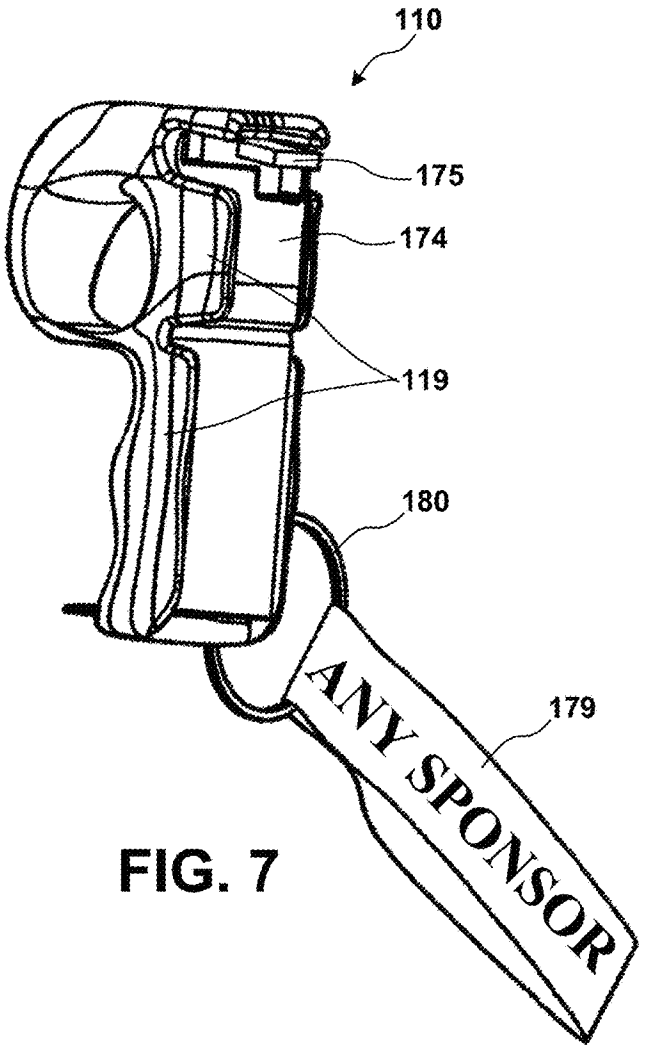
FIGS. 6 and 7 are front and rear perspective views of the self-defense device of FIGURE A.
Figure 6:
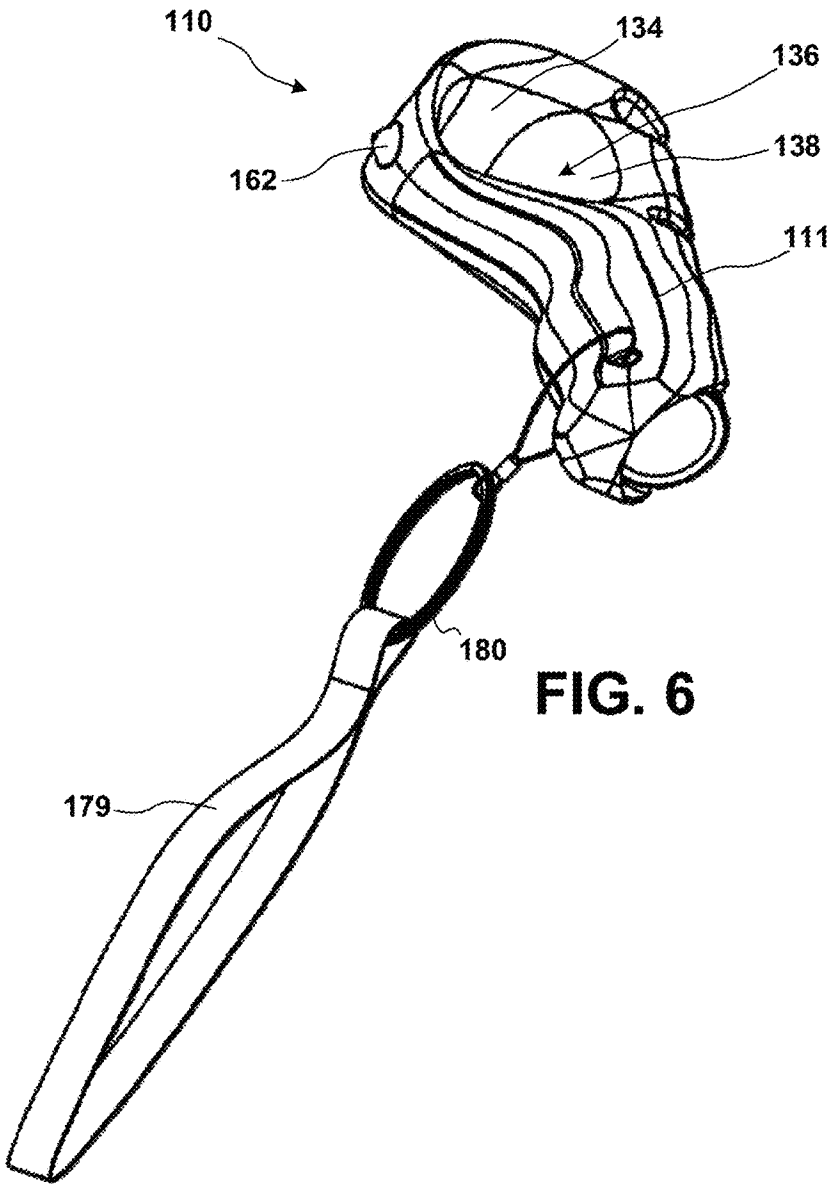
Figure 9:
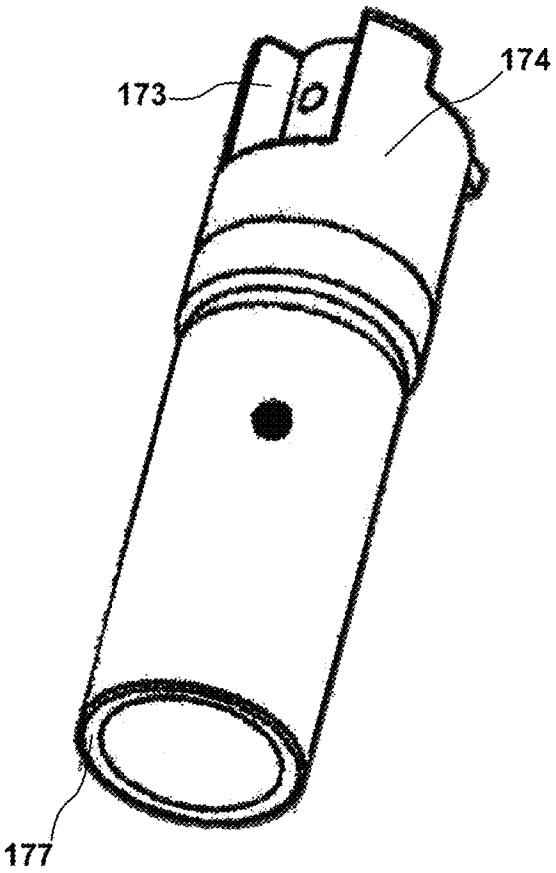
FIG. 9 is a perspective view of a replaceable repellant spray container in accordance with aspects and features of inventive concepts shown and described herein, which can be configured for use with the self-defense device of FIG. 5A.
Figure 8:
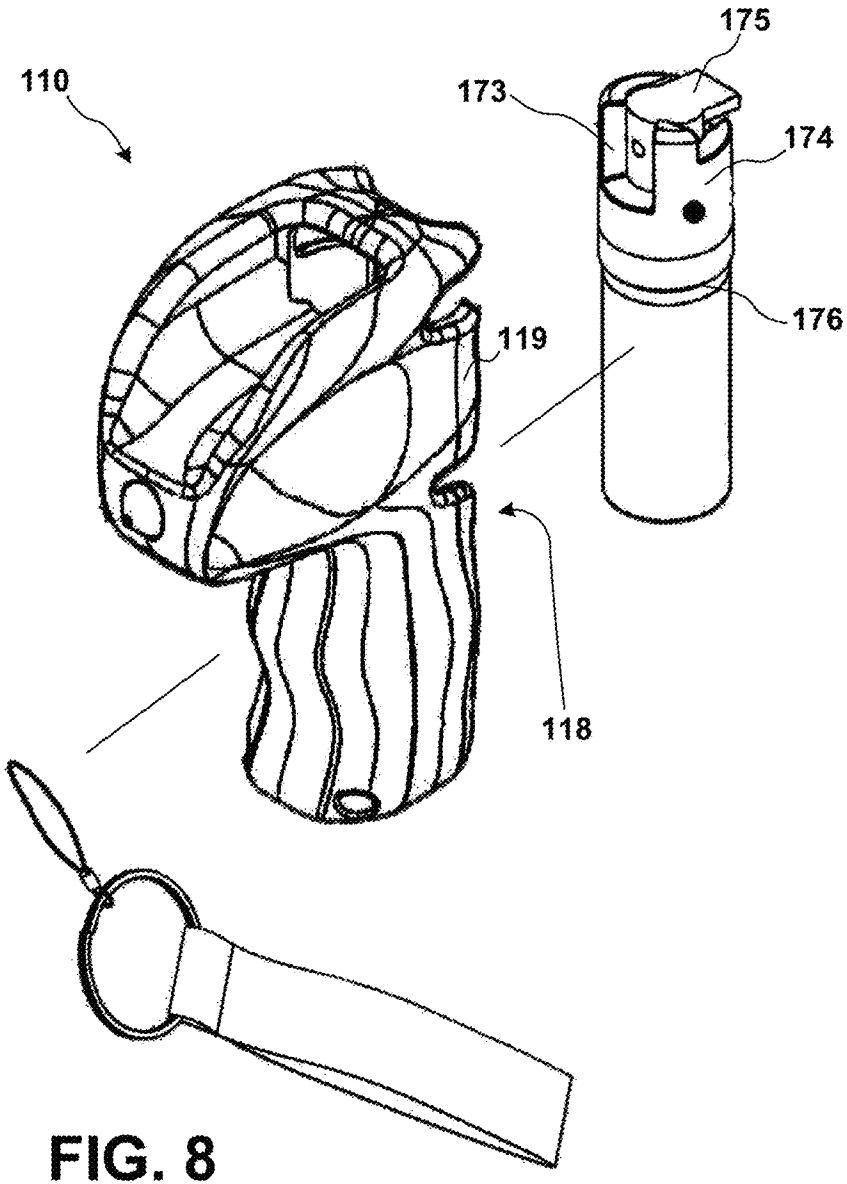
FIG. 8 is an exploded perspective view of the self-defense device of FIG. 5A.
Figure 10B:
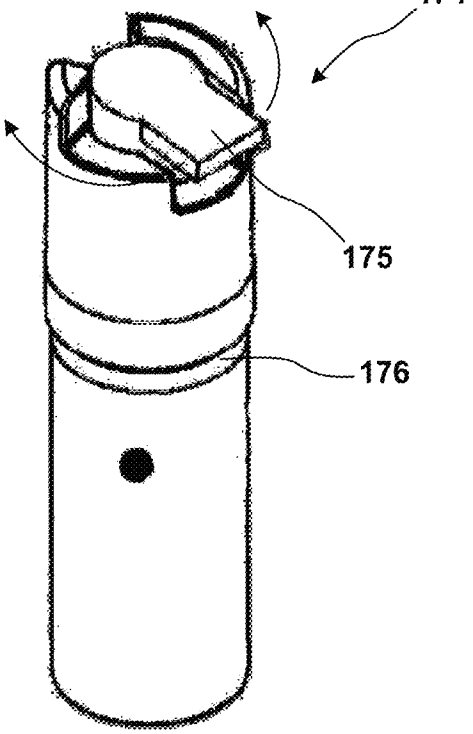
FIG. 10B is a top perspective view of the example replaceable repellant spray container of FIG. 9.
Figure 10A:
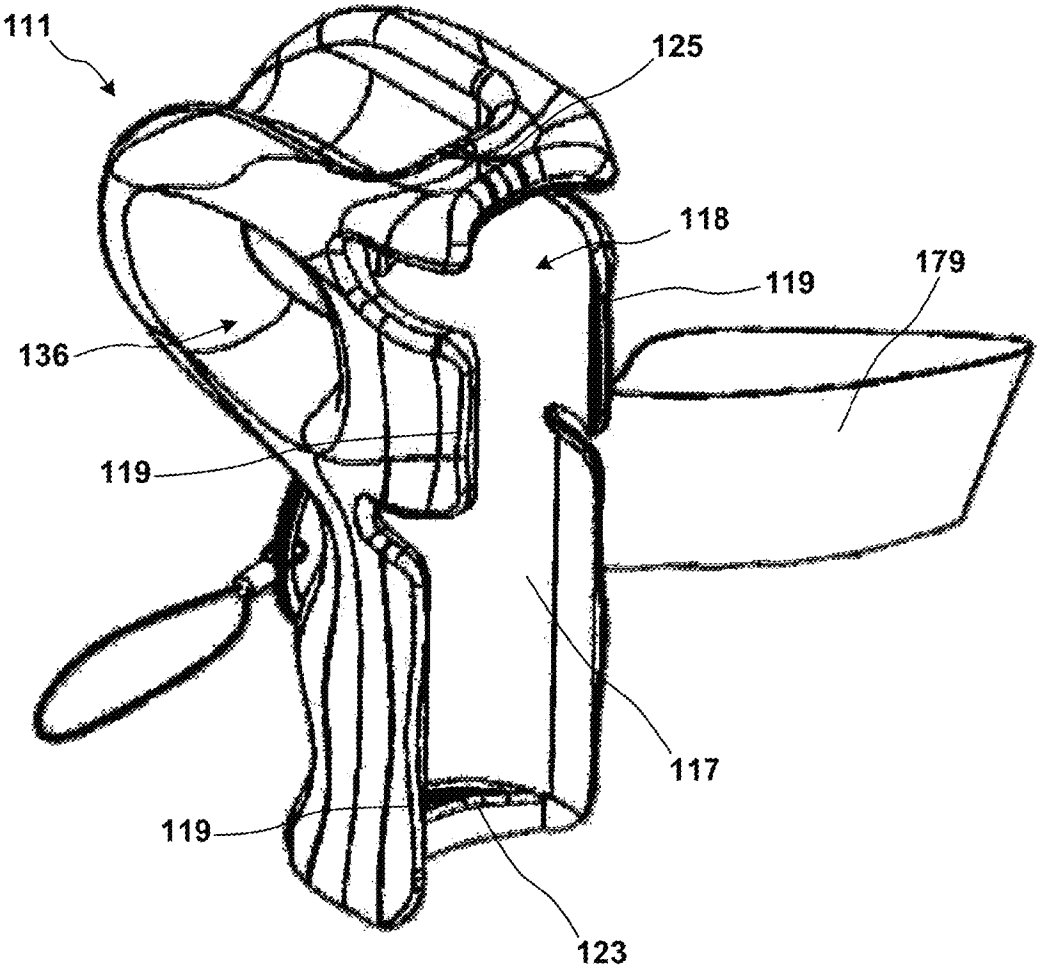
FIG. 10A is a top rear perspective view of the body for the example self-defense device of FIG. 5A.
Figure 12:
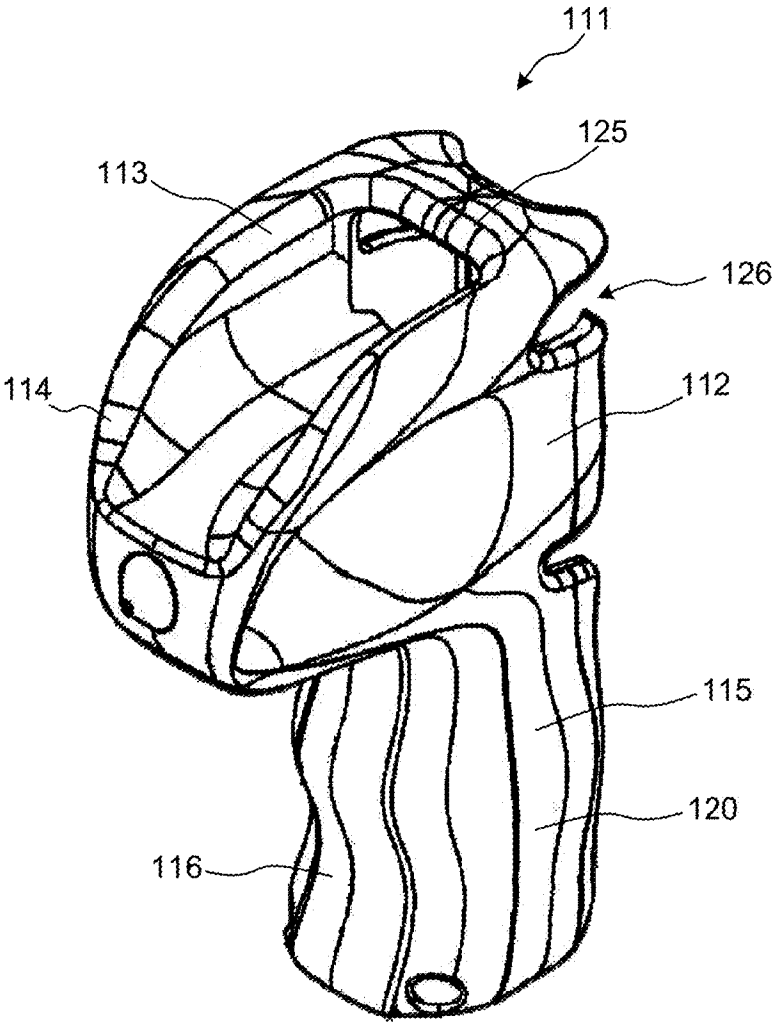
FIG. 12 is top front perspective view of the same.
Figure 11:
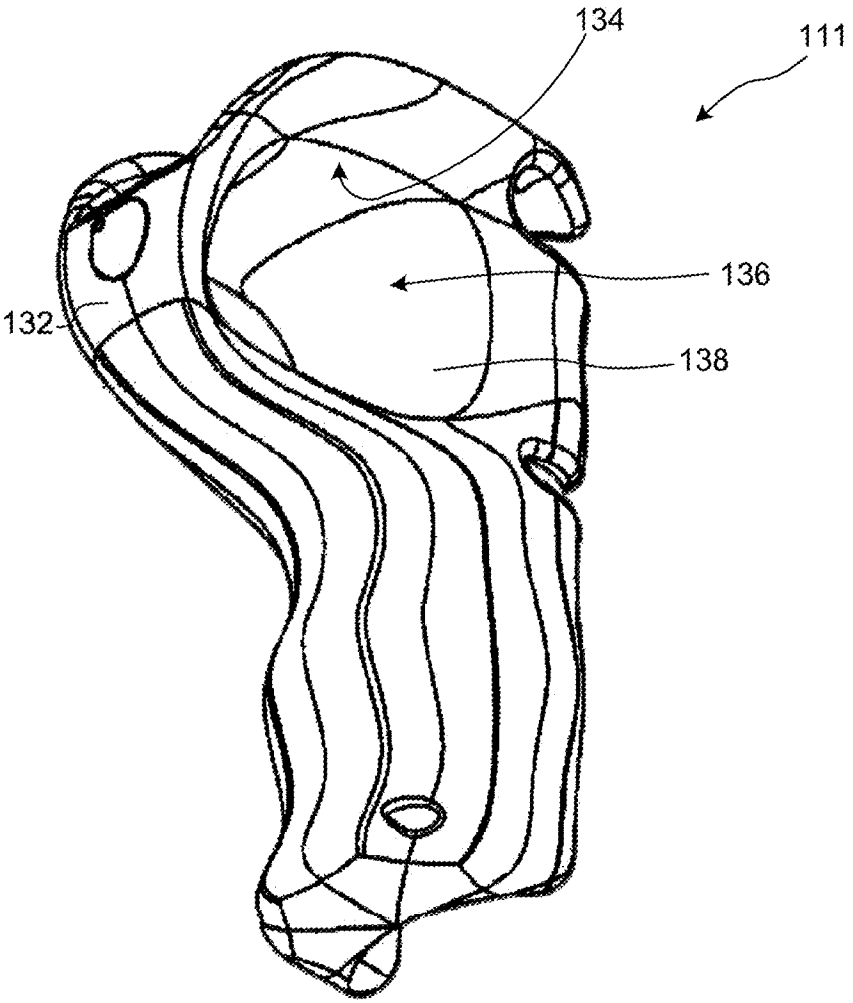
FIG. 11 is a lower front perspective view of the body of FIG. 10A.

As can be seen in FIGS. 6-8, the self-defense device 110 can further include a wrist strap 179 attached to the elongate body 111, which can allow the user to carry the self-defense device 110 while exercising or walking for easy access. As desired, a logo or sponsor ship indicia can be printed or otherwise placed on the wrist strap. The wrist strap can be connected to the body 111 via a cable or ring 180 extending through one or more holes 178 defined through the body.

Figure 25:
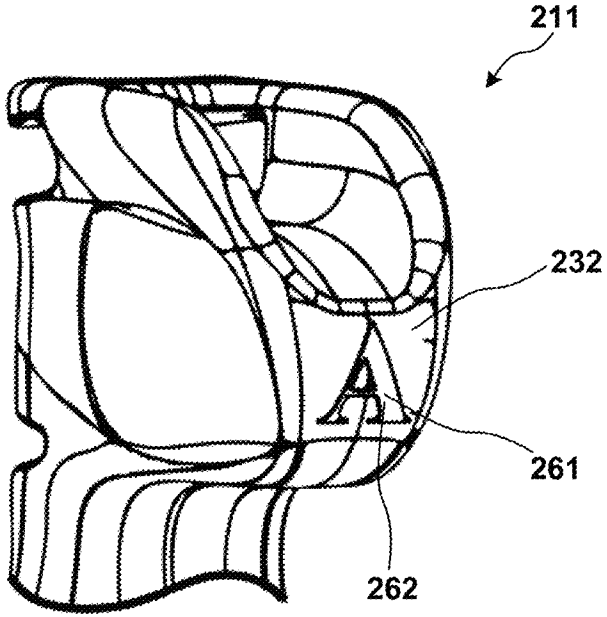
FIG. 25 is a partial front perspective view of an optional configuration of the self-defense device of FIG. 5A showing an example logo insert that can be embedded in a portion of the body of self-defense device and can optionally provide dual functionality as DNA collector.

Referring now to FIG. 25, another example configuration of a body 211 for a self-defense device is shown, which generally includes the aspects and features described above for body 111 and device 110 except pertaining to the tip portion 232. As shown, tip portion 232 includes a raised letter "A", which is shown as an example logo or other indicia 261 that can be embedded in the body 211. Further, the indicia 261 can provide a dual purpose and act as a DNA collector 262 via sharp edge portions. The embedded indicia 261 and DNA collectors 262 for body 211 and other example arrangements can be formed as metallic or non-metallic materials.

Figure 26:
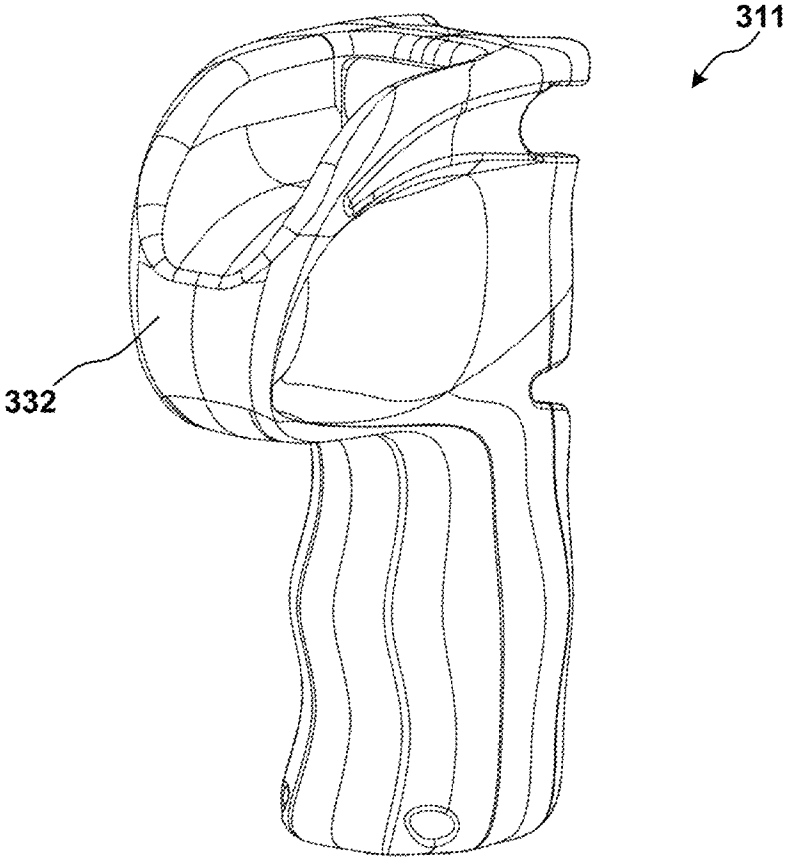
FIG. 26 is a partial front perspective view of another option configuration of the self-defense device of FIG. 5A without a DNA collector included at a front portion of the device.

Referring now to FIG. 26, another example body 311 is shown, which also includes the aspects and features discussed above, except with respect to inclusion of a DNA collector. As shown, the tip portion 332 shown lacks any DNA collector as an optional configuration for the body and corresponding self-defense device.

Figure 27A:
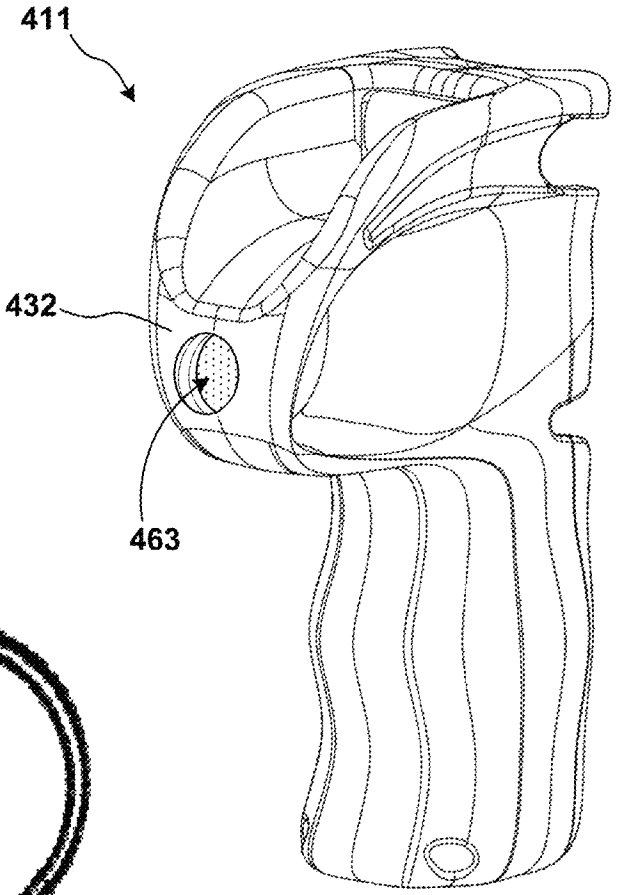
FIG. 27A is a front left perspective view of a further optional configuration for the self-defense device of FIG. 5A showing an optional removal, embedded option for a DNA collector in the self-defense device.
Figure 27B:
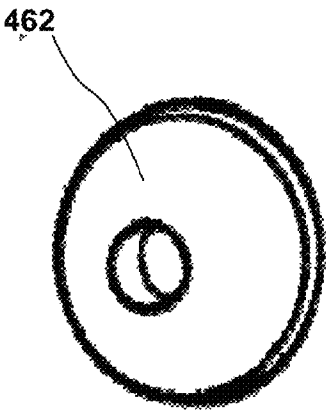
FIG. 27B shows the DNA collector insert.
Figure 30:
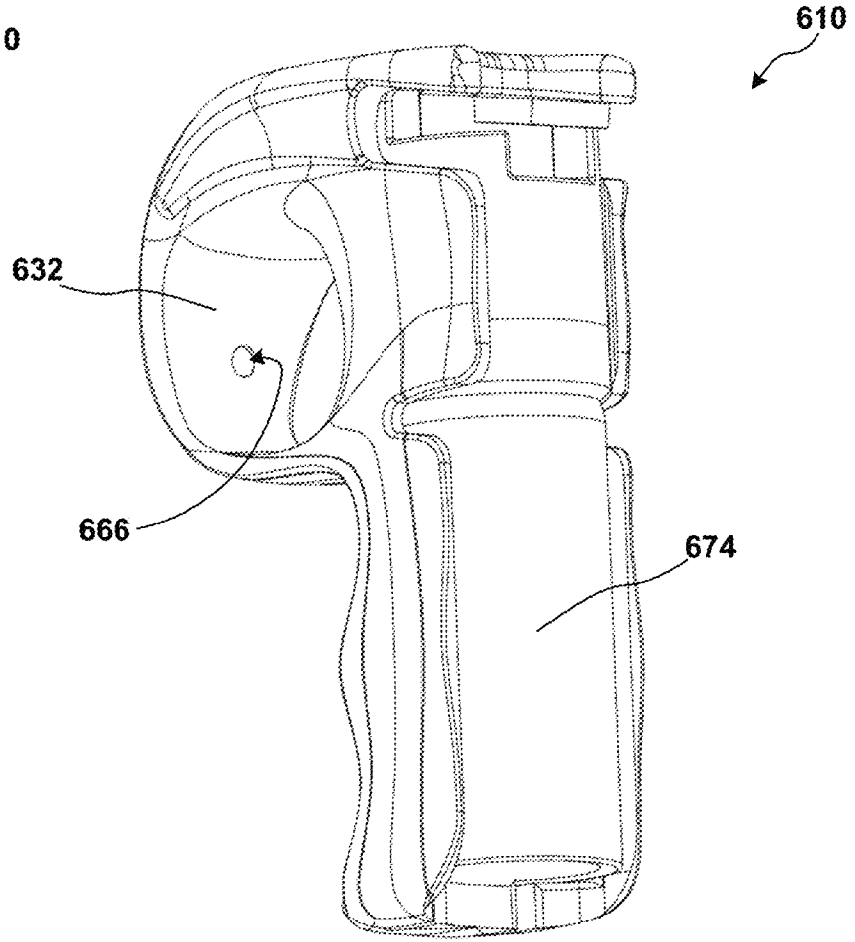
FIG. 29 is a front perspective view and FIGS. 30 to 32 are rear perspective views for a further optional arrangement of the self-defense device of FIG. 5A.
Figure 29:
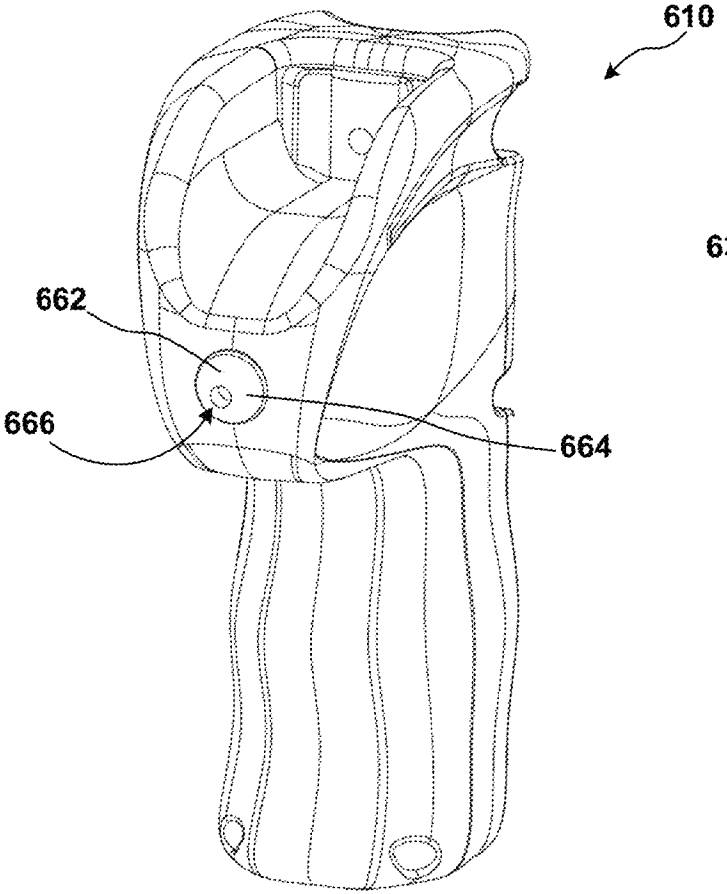
Figure 32:
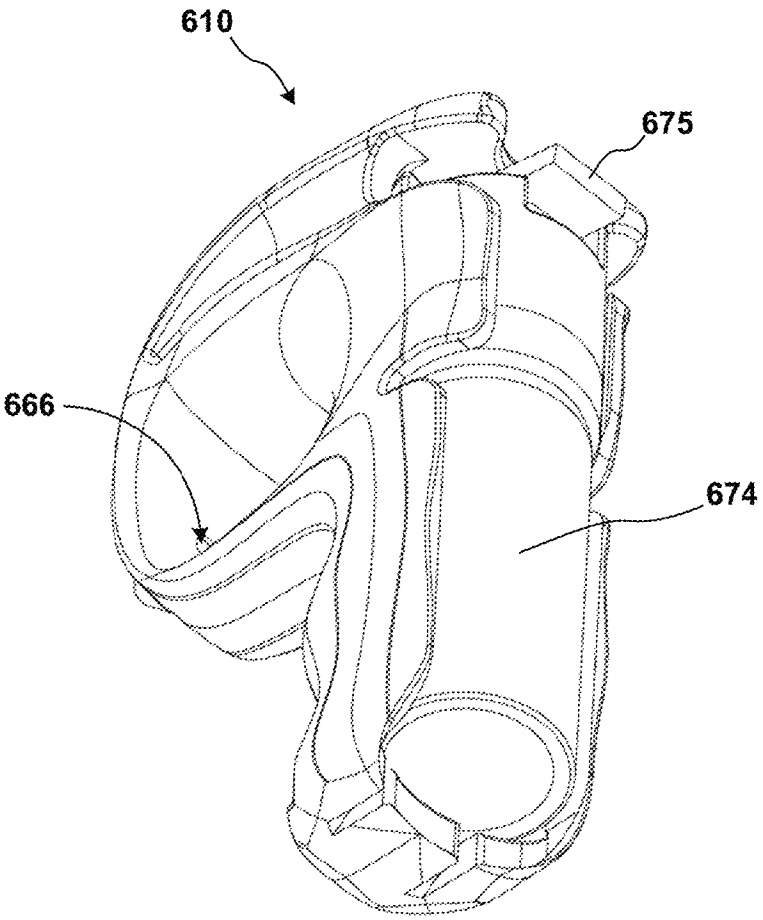
Figure 31:
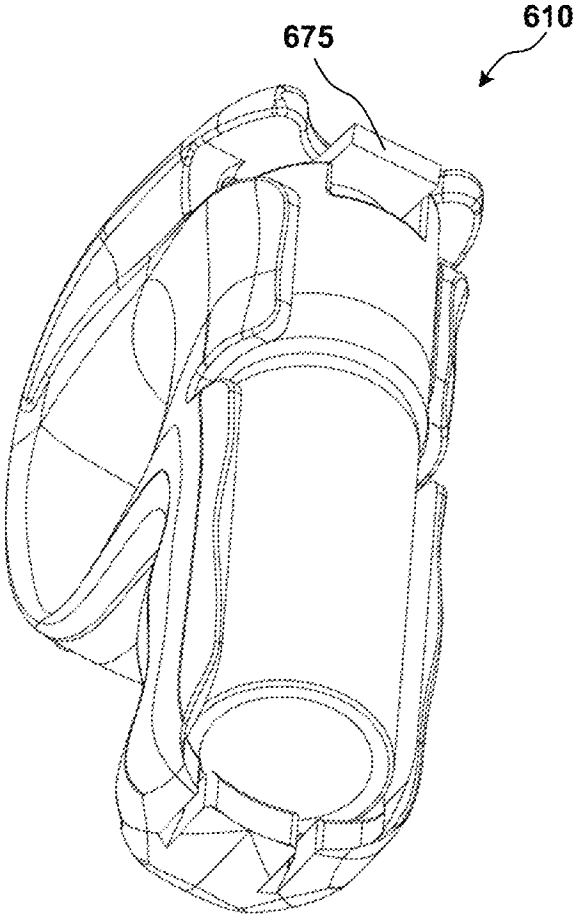
Figure 34:
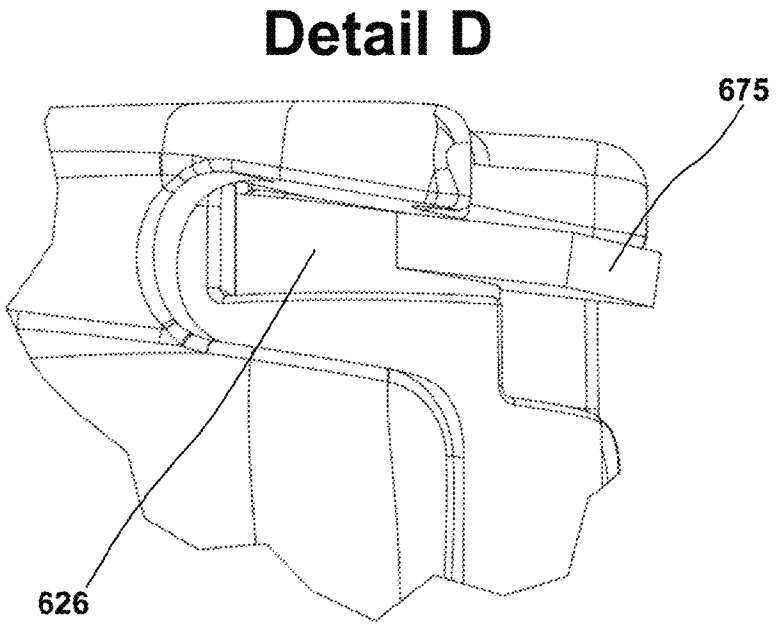
FIGS. 34 and 36 show corresponding Detail Views D & E as indicated in FIGS. 33 & 35.
Figure 33:
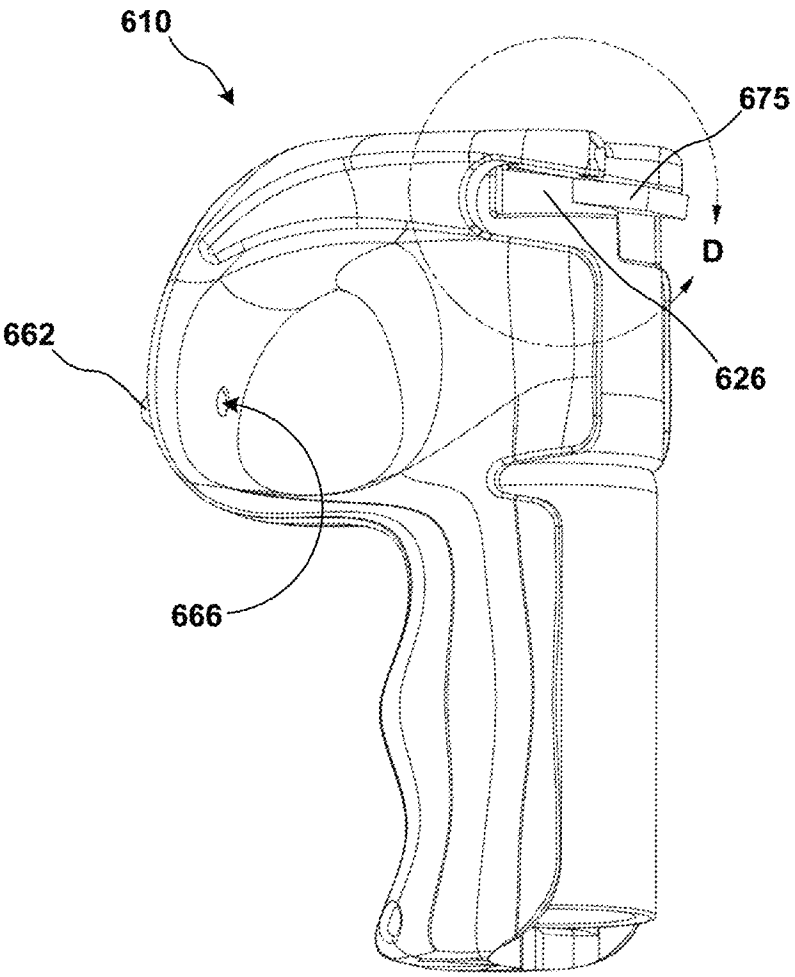
FIGS. 33 and 35 are side perspective views of the self-defense device of FIG. 29 showing locked and unlocked positions for the spray actuator.
Figure 36:
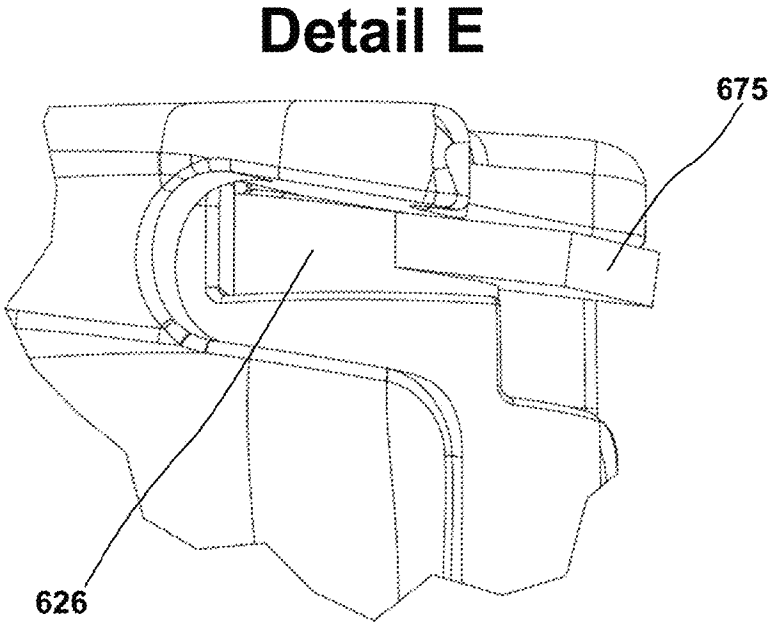
Figure 35:
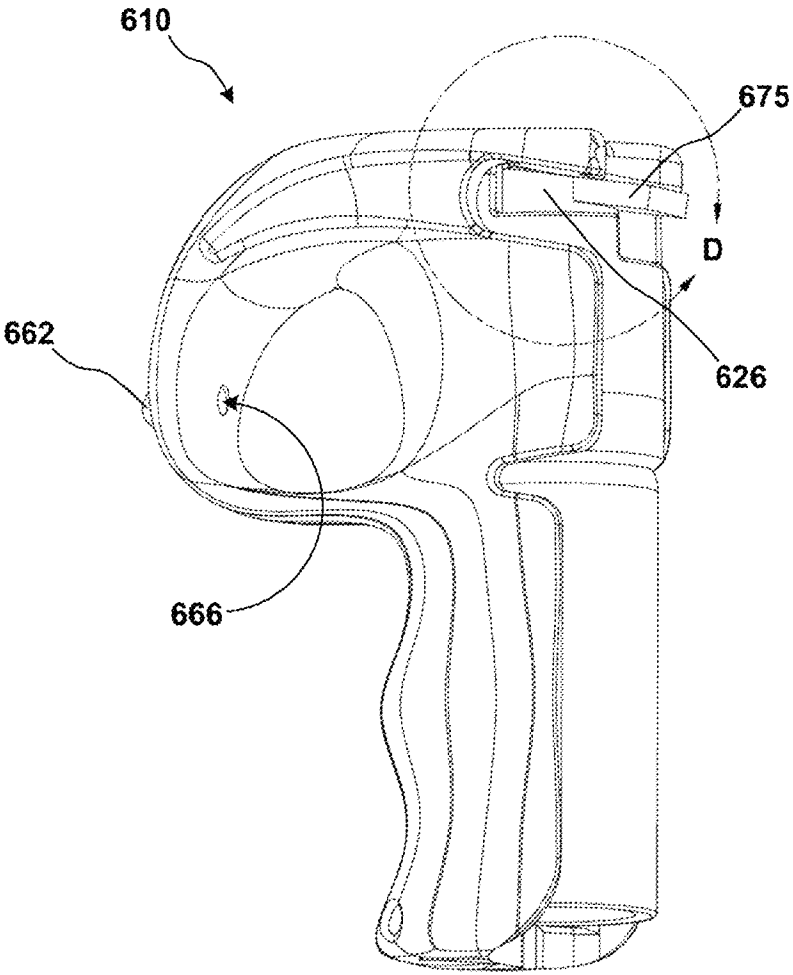
Figure 38:
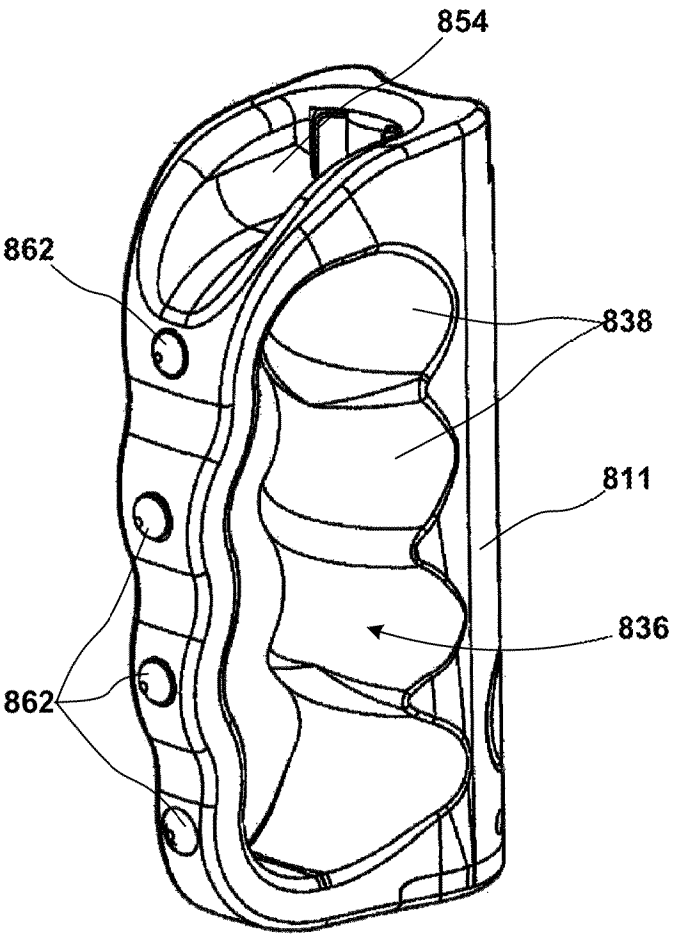
FIGS. 38 to 42 are perspective views of the example self-defense device arrangement of FIG. 32.

Referring now to FIG. 27A along with FIG. 27B, another example body 411 is shown, which also includes the aspects and features discussed above, except with respect to the DNA collector. As shown, a DNA collector 462 can be configured as a replaceable component that can be screwed into and out of, or otherwise swappable or replaceable with an opening 263 formed at the tip portion 432.

Figure 28:
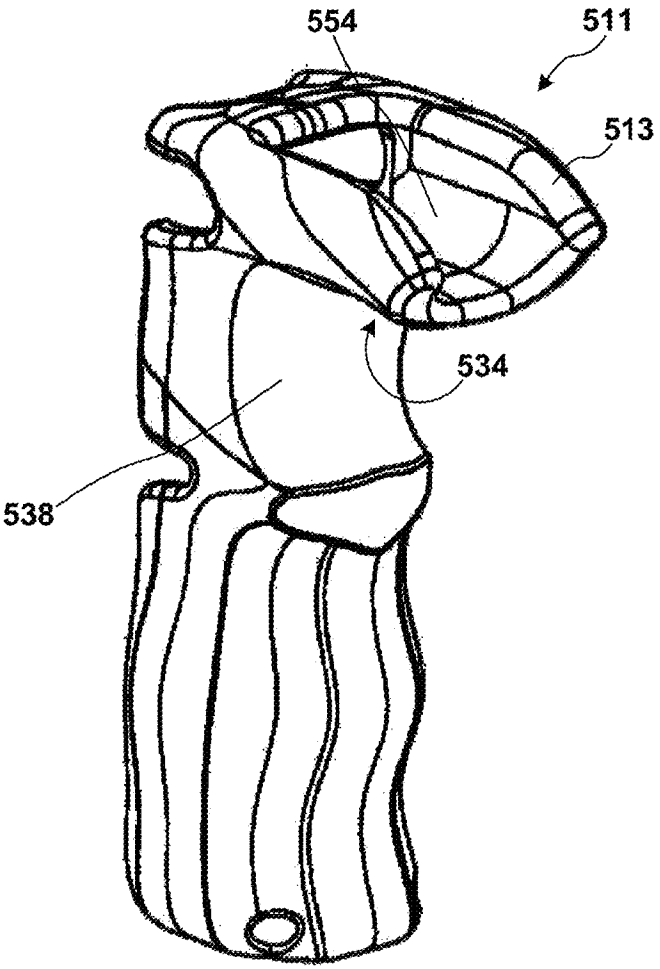
FIG. 28 is a front right perspective view of an optional body configuration for the self-defense device of FIG. 5A.

Referring now to FIG. 28, another example body 511 is shown, which includes the aspects and features discussed above, except for the lack of a closed index finger opening.

Referring now to FIGS. 29 to 36, another example self-defense device 610 is shown, which includes the aspects and preferences of self-defense device 110, except with respect to the DNA collector 662. As shown, DNA collector 662 is formed with dimple 666 extending completely through the tip portion 632.

Figure 37:
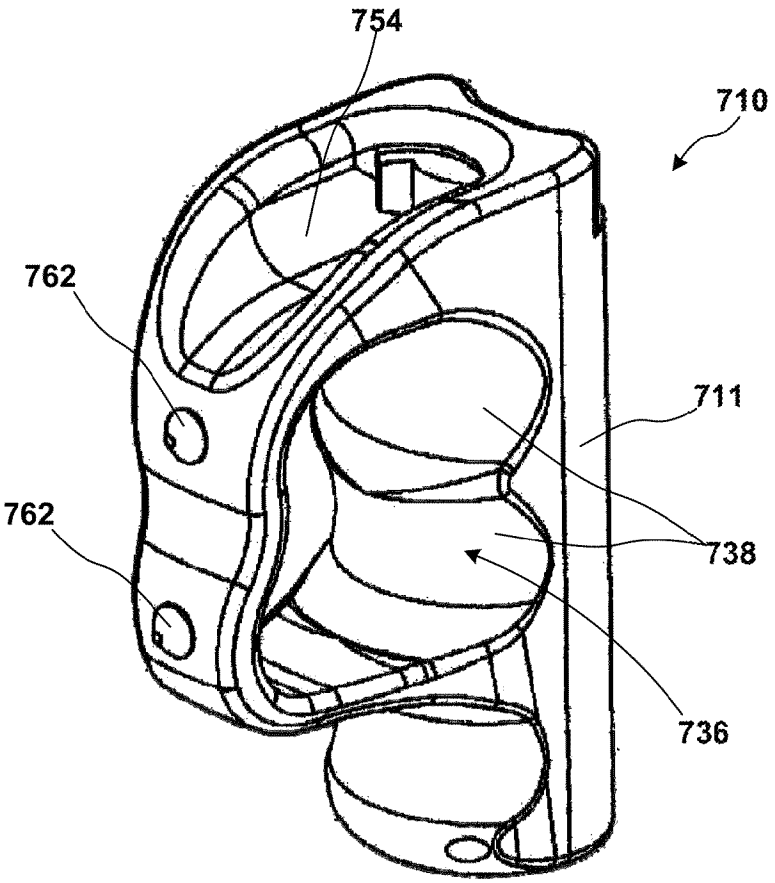
FIG. 37 is a perspective view of an additional example arrangement of a self-defense device according to aspects and features of inventive concepts described herein.
Figure 40:
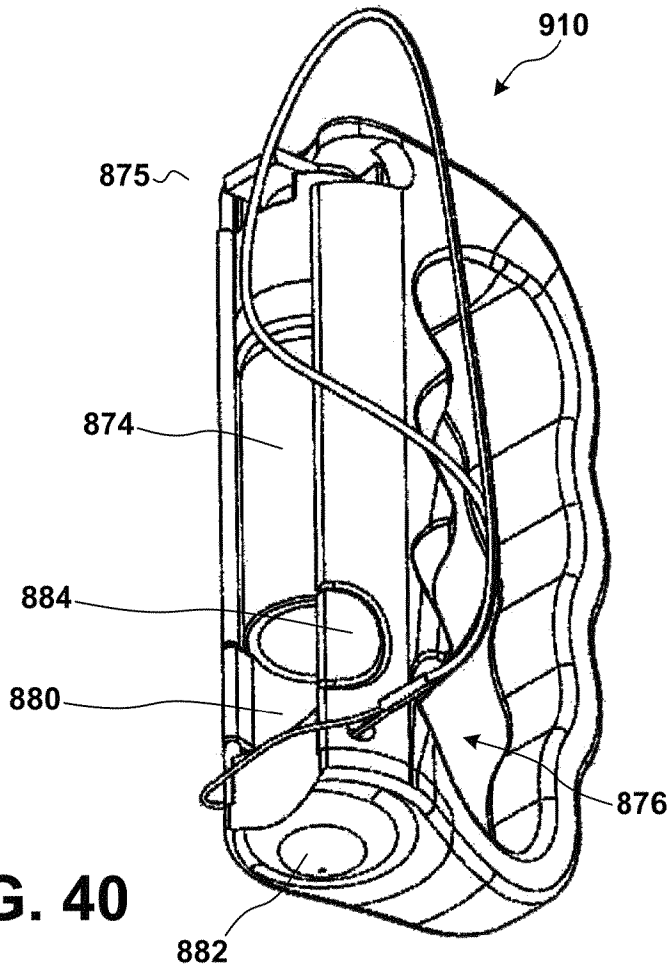
Figure 39:
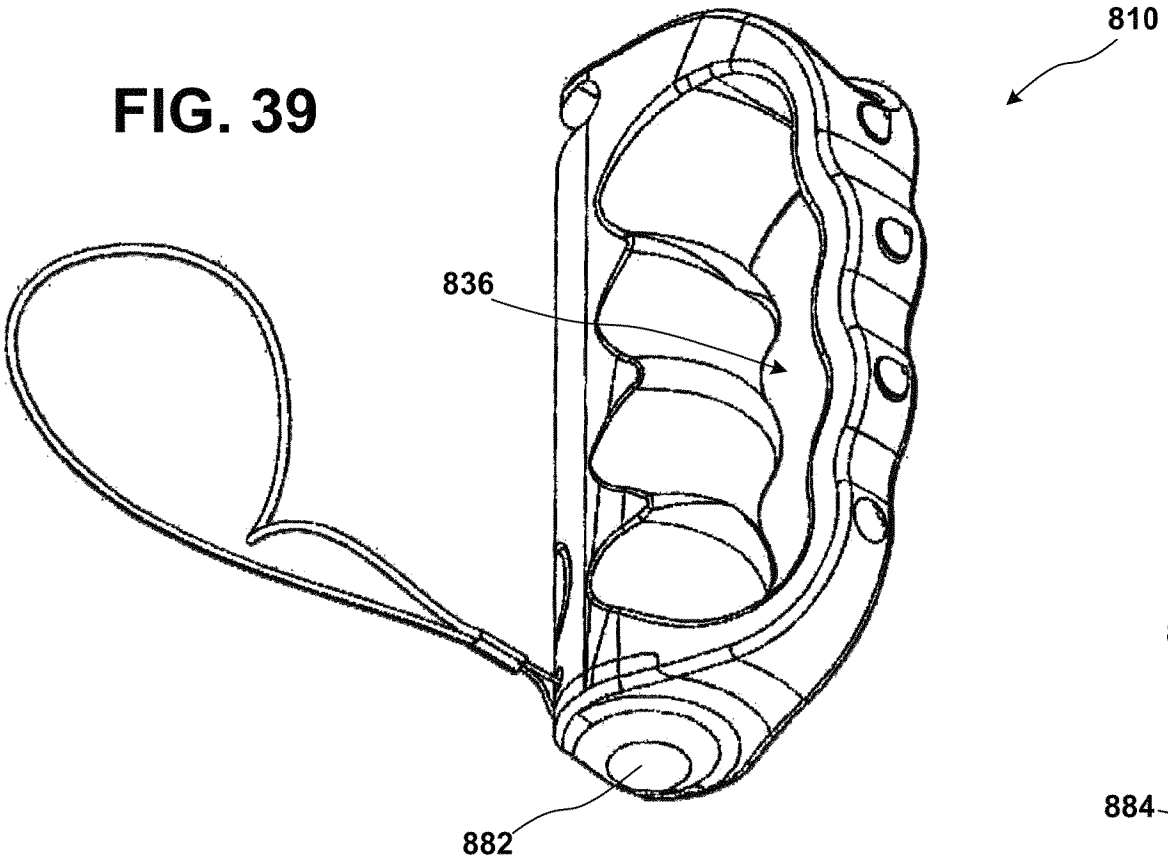
Figure 42:
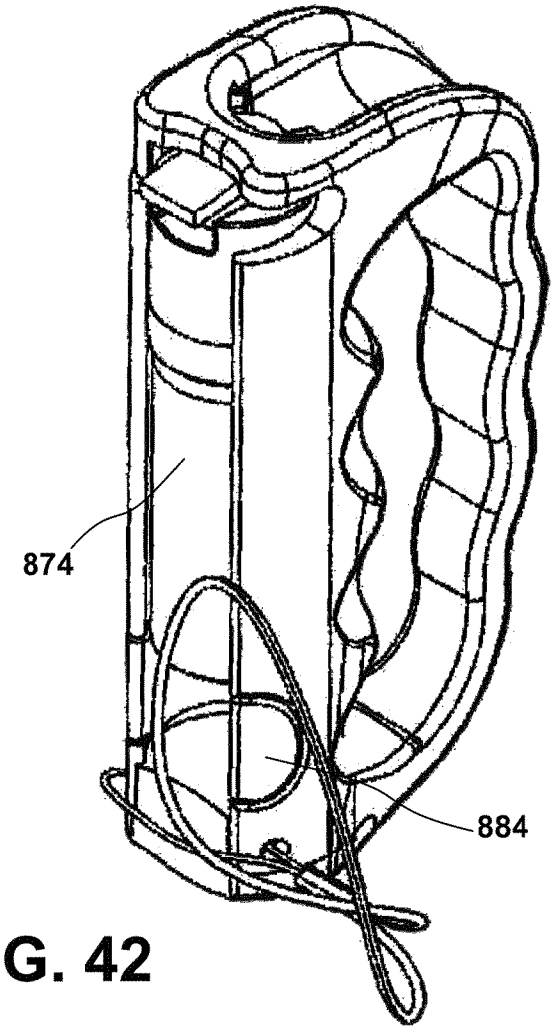
Figure 41:
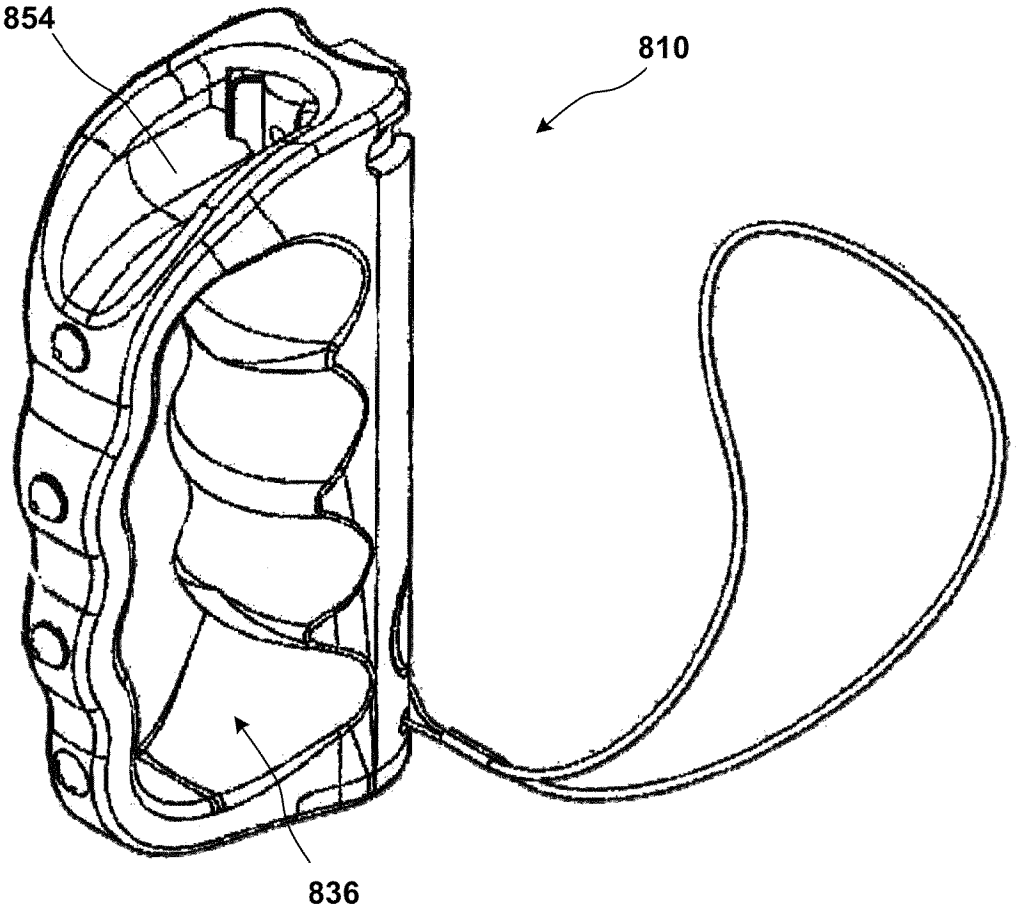

Referring now to FIG. 37, a further example self-defense device 710 is shown, which includes the aspects and preferences of self-defense device 110, except with respect to the finger opening 736. It is understood herein and throughout the specification that like numbers refer to like features. As shown, self-defense device 710 includes a finger opening 736 that is shaped and sized for two of the user's fingers particularly the index finger and middle finger, and includes finger contours 738 for each finger. In addition, two DNA collectors 762 are disposed on the tip portion of the device. Such an arrangement can further enhance the user's ability to readily grip and orient the device properly for use and improve the firm grip via two fingers placed through the finger opening 736. In addition, self-defense device 710 provides a plurality of DNA collectors 762 for enhancing the likelihood for obtaining a useful DNA sample.

Referring now to FIGS. 38 to 46, a further example self-defense device 810 is shown, which includes the aspects and preferences of self-defense device 110, except with respect to the finger opening 836, storage cavity 818, and bottom plug 880. Like numbers refer to like features. As shown, self-defense device 810 includes a finger opening 836 that is shaped and sized for all four of the user's fingers, and includes finger contours 838 for each finger. In addition, a plurality of DNA collectors 862 are disposed on the tip portion of the device, which as shown can include four DNA collectors. Such an arrangement can further enhance the user's ability to readily grip and orient the device properly for use and improve the firm grip via all four fingers placed through the finger opening 836. In addition, self-defense device 810 provides a plurality of DNA collectors 862 for enhancing the likelihood for obtaining a useful DNA sample.

Figure 44:
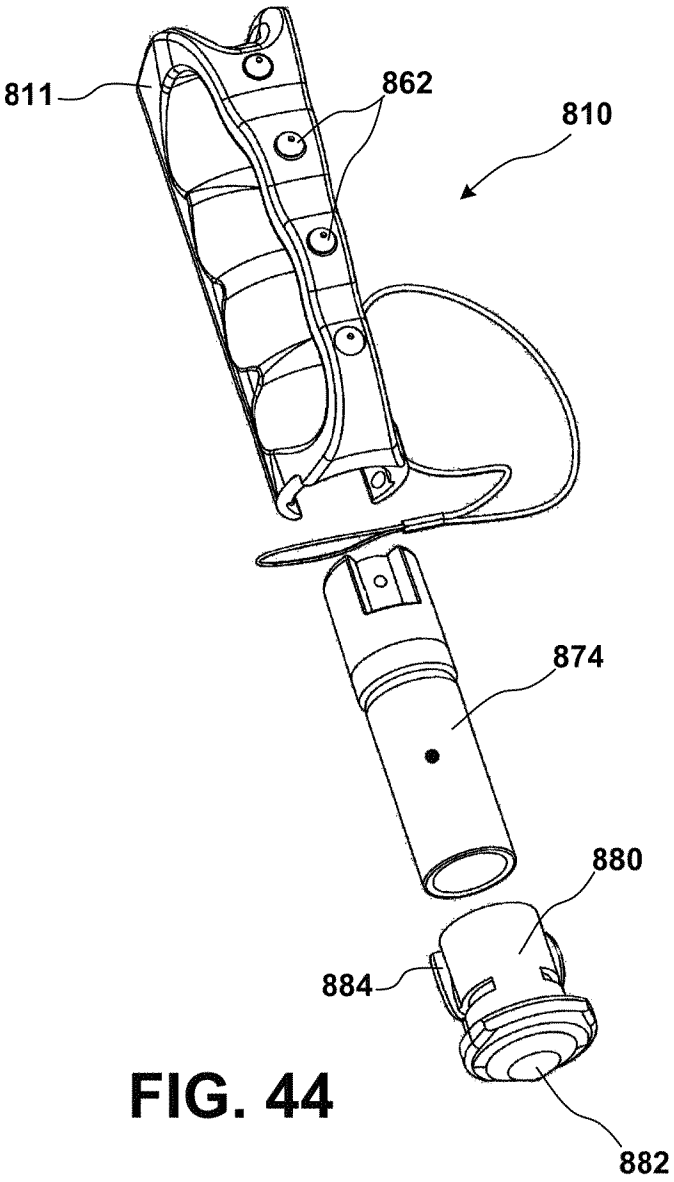
FIGS. 43 and 44 are front and rear exploded perspective views of the self-defense device arrangement of FIG. 37.
Figure 43:
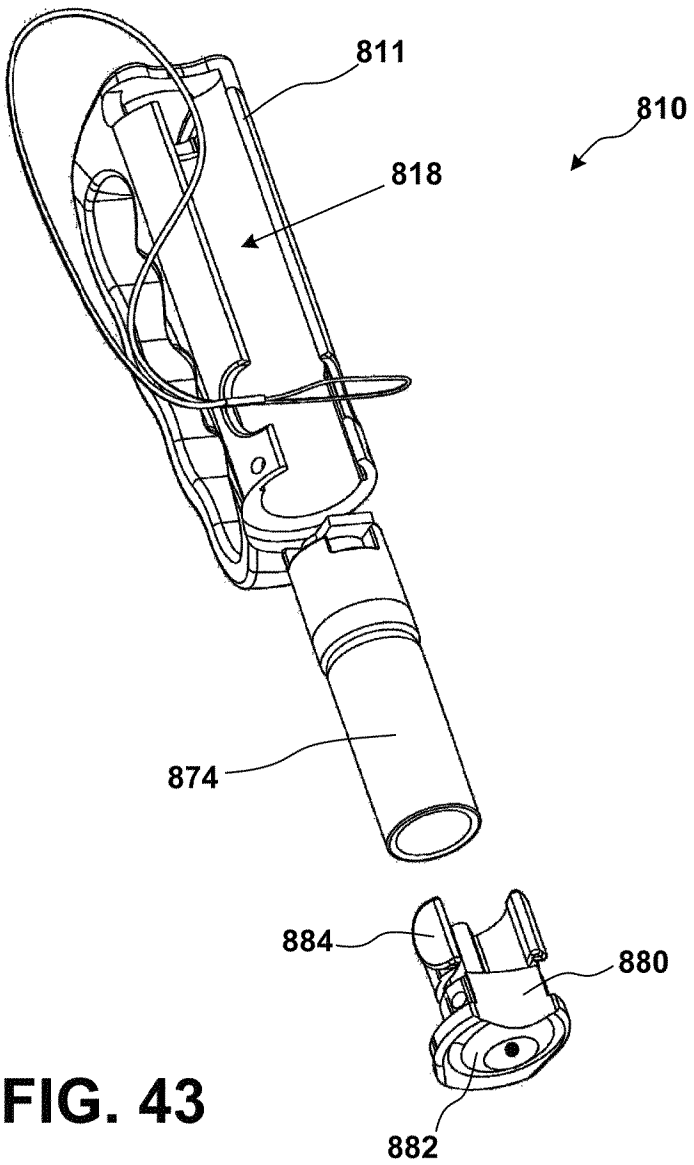
Figure 46:
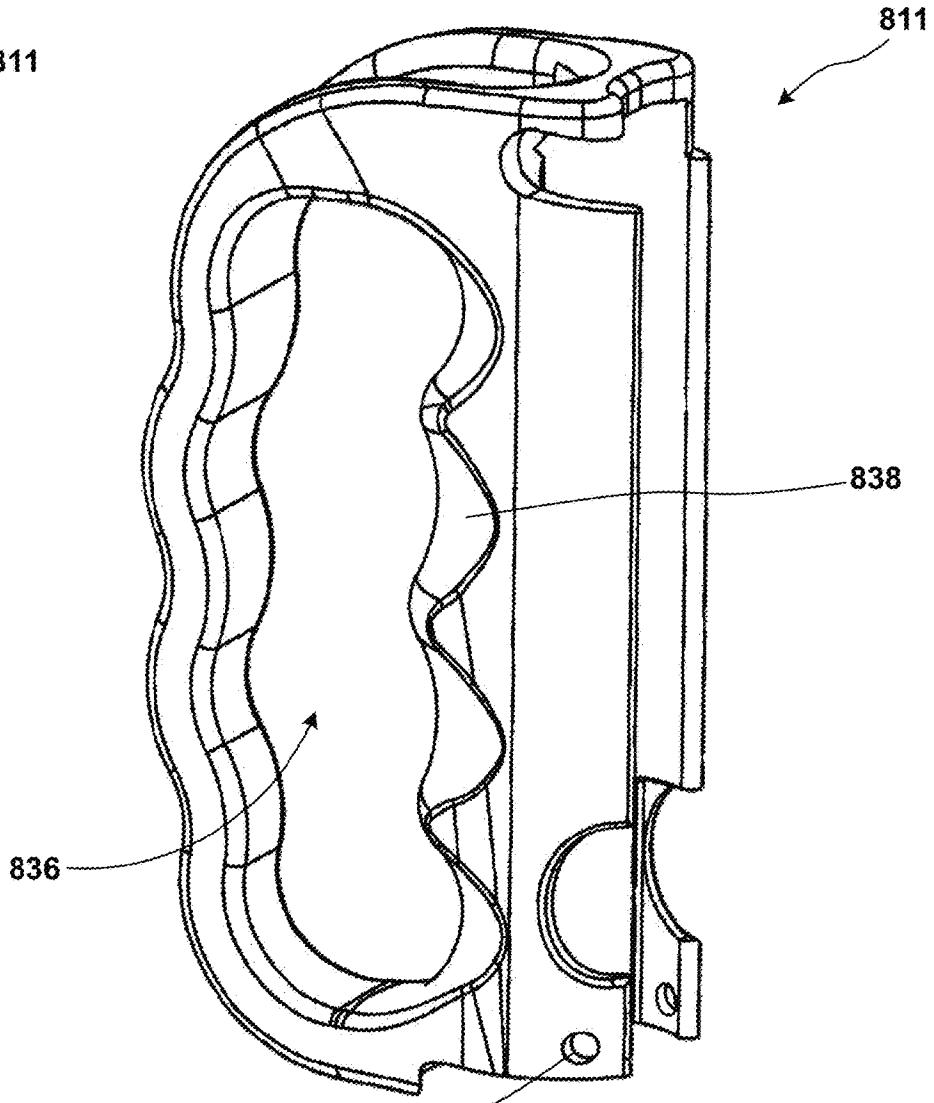
FIGS. 45 and 46 are front and rear perspective views of the body of the self-defense device of FIG. 37.
Figure 45:
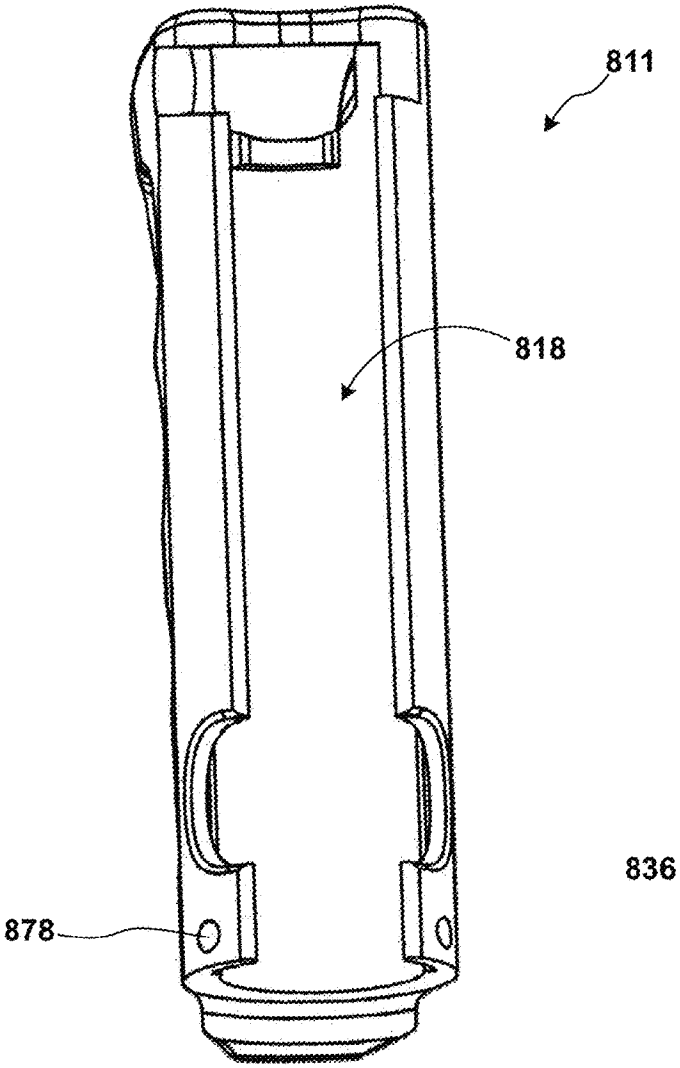
Figure 48:
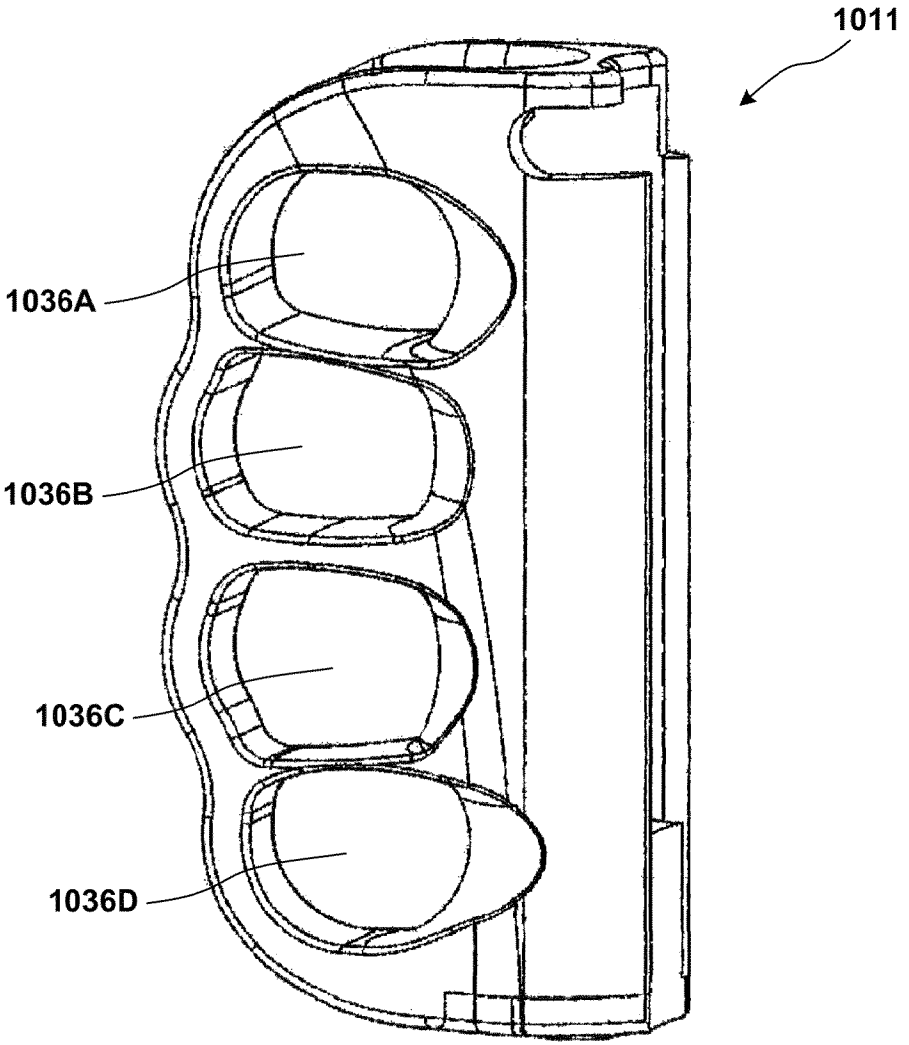
FIGS. 47 and 48 are side elevation views of optional example self-defense arrangements for the grip portion for a self-defense device arrangement similar to the device of FIG. 37.
Figure 47:
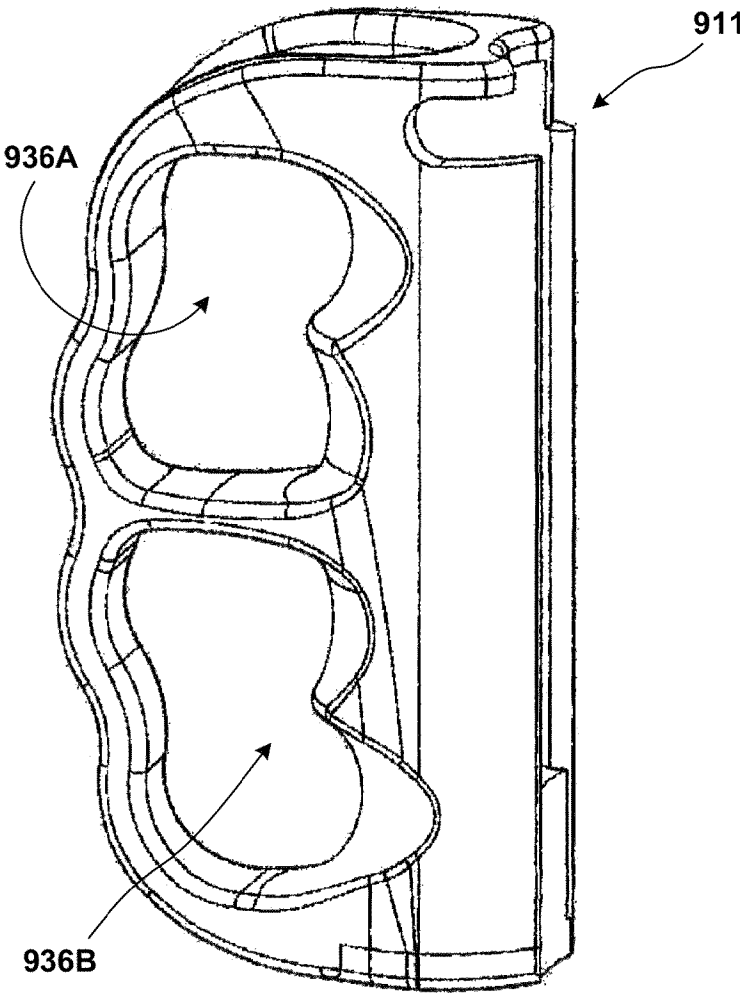

As can be seen, for example, in FIGS. 43 and 44, a plug 880 can be received at a lower end of the storage cavity 818 for securely retaining the repellant container 874. The plug 880 can include flexible a pair of flexible or spring-loaded plug clips 884 configured to mate with corresponding slots in the body 811 for allowing ready removal of the plug 880 for replacing the repellant container 874.

Furthermore, a bottom end of the plug 880 can include a hard window breaker 882, which can include a hard tip. The window breaker 882 can be formed fully or partially from a metallic material. Notably, a tip portion of the window breaker 882 can concentrate forces at the tip portion for aiding in breaking glass, such as a vehicle window for escaping after an accident. The location of the window breaker 882 at the bottom end of the self-defense device 810 oriented substantially perpendicular to the user's grip allows the user to apply maximum force in a downward motion for apply breakage force to a window.

Referring now to FIGS. 911 and 1011, additional examples of self-defense body configurations 911 and 1011 are shown, which includes the aspects and preferences of self-defense device 810, except with respect to the finger openings 936A &B and 1036A-D. Like numbers refer to like features. As shown, self-defense device bodies 911 and 1011 include a plurality of finger openings 936A & B and 1036A-D that are shaped and sized for either two pairs of the user's fingers each (936A & B) or for each of the individual user's fingers (1036A-D) along with including finger contours for each finger. Supplemental frame members are included between the finger openings to reinforce the frame structure. In addition, a plurality of DNA collectors can be disposed on the tip portion of the device. Such arrangements can provide enhanced gripping of the corresponding self-defense device.

Figure 49:
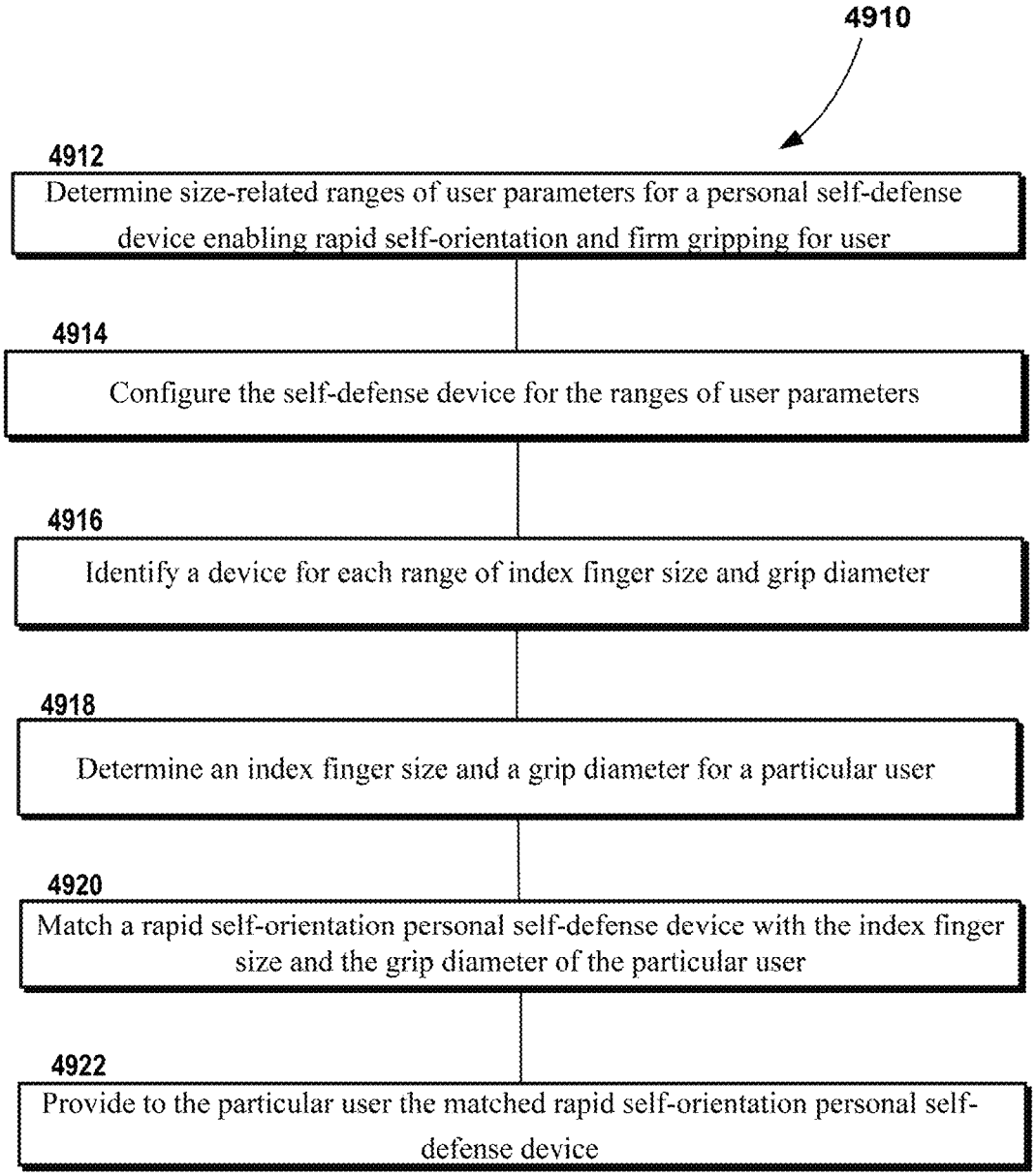
FIG. 49 is a schematic representation of a method pertaining to aspects and features of inventive self-defense device concepts described herein.
Figure 51:
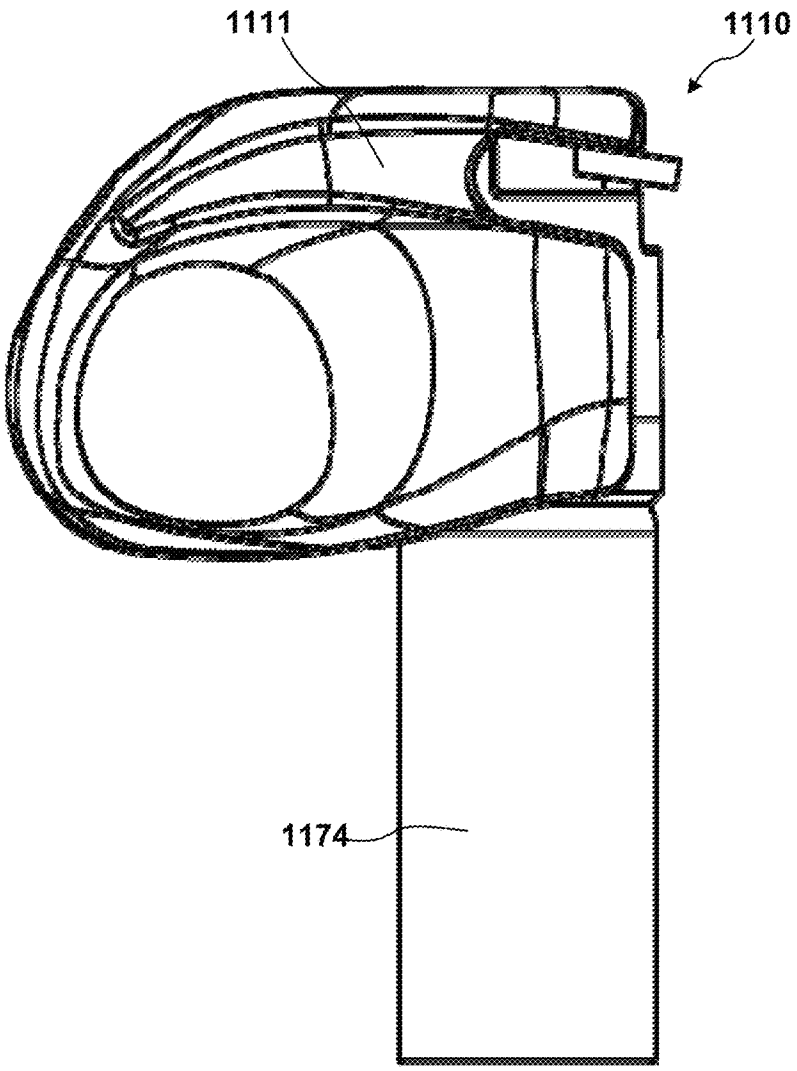
FIGS. 51-53 are left side, rear, and front views of the self-defense device of FIG. 50.
Figure 50:
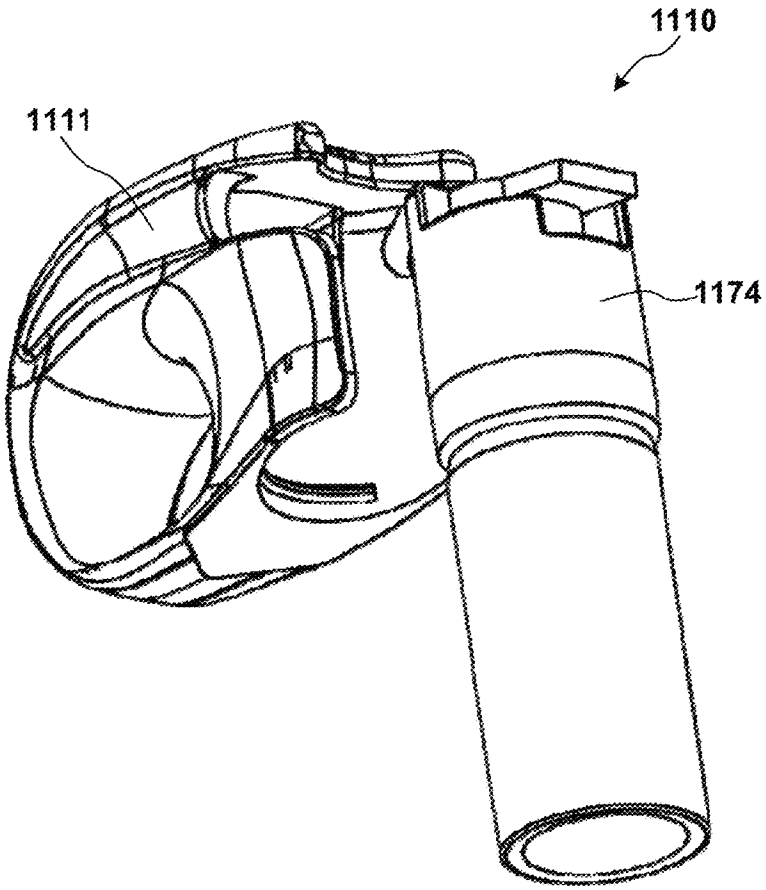
FIG. 50 is a perspective exploded view of another example rapid response self-defense and repellant spray device in accordance with aspects and features of inventive concepts shown and described herein.
Figure 53:
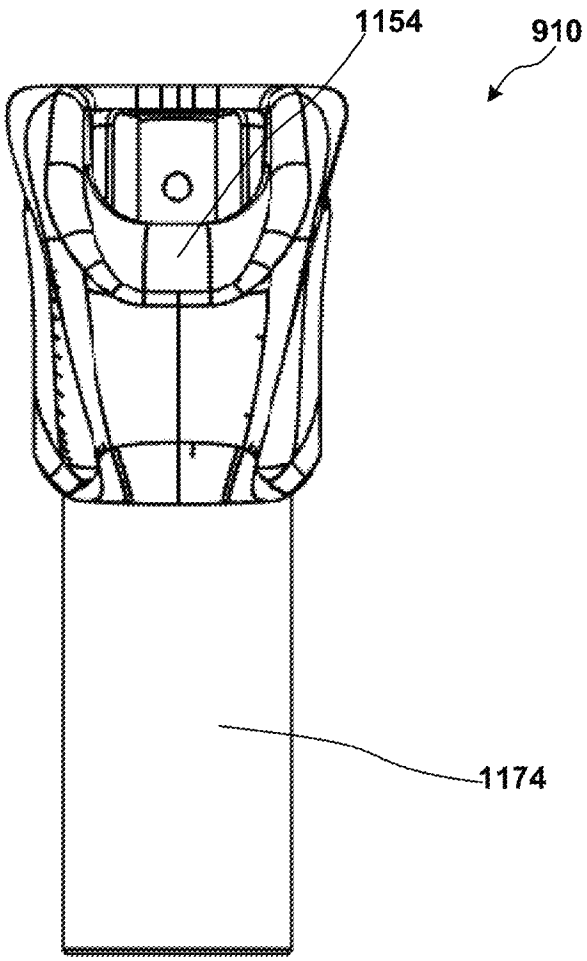
Figure 52:
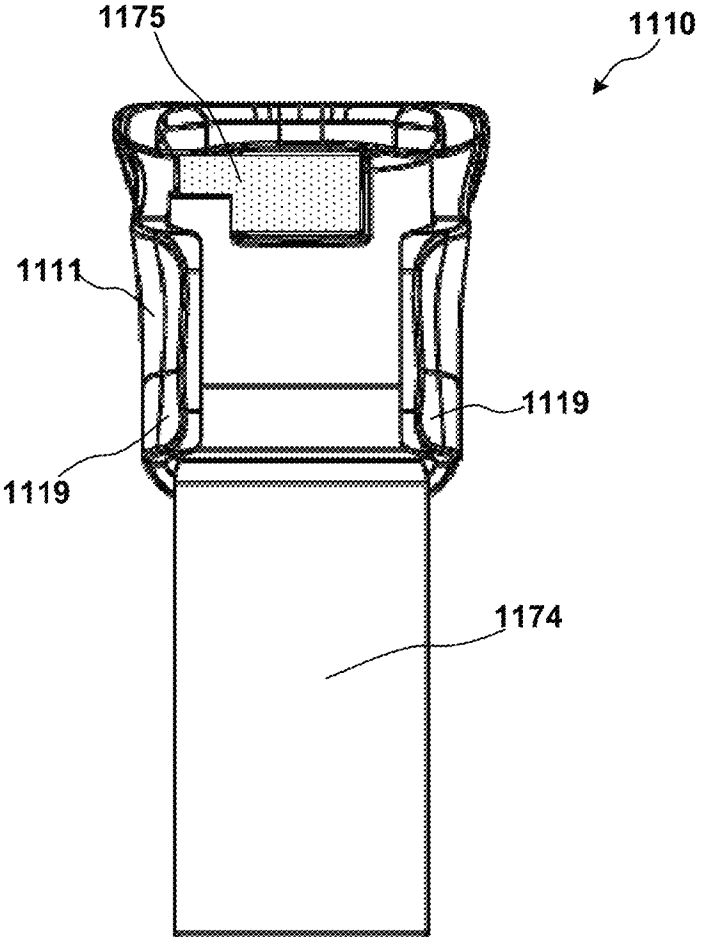
Figure 55:
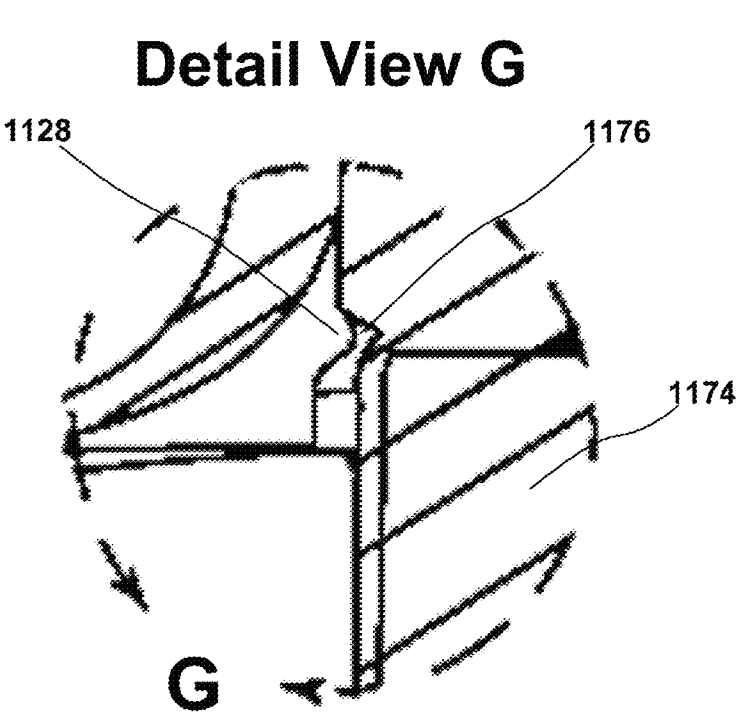
FIG. 55 shows Detail View G of the retention feature identified in FIG. 54.
Figure 54:
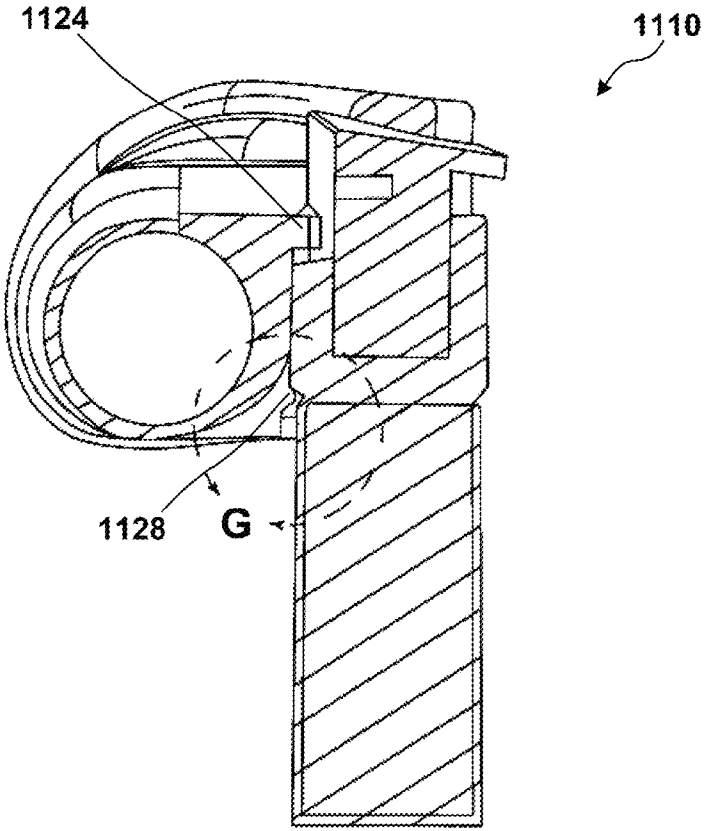
FIG. 54 is a cross-sectional view of the self-defense device of FIG. 50 showing some retention features for self-defense device as an assembly with a repellant spray container.
Figure 57:
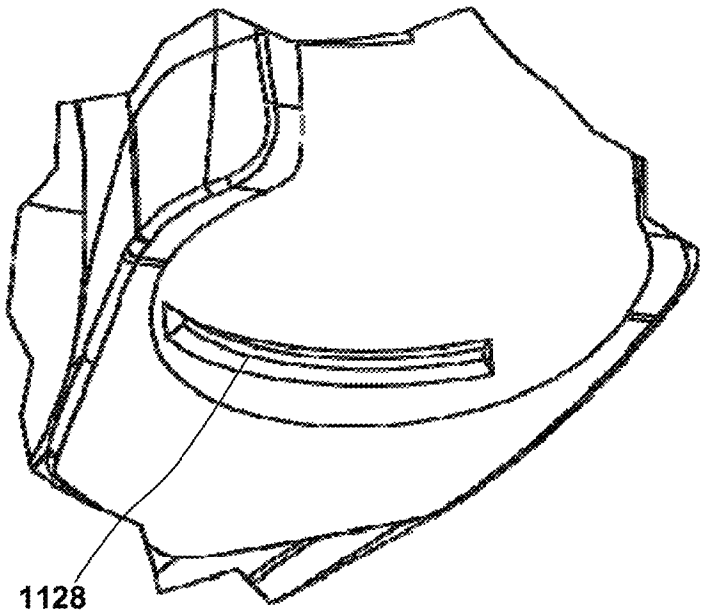
FIG. 57 shows Detail View H of the retention feature identified in FIG. 56.
Figure 56:
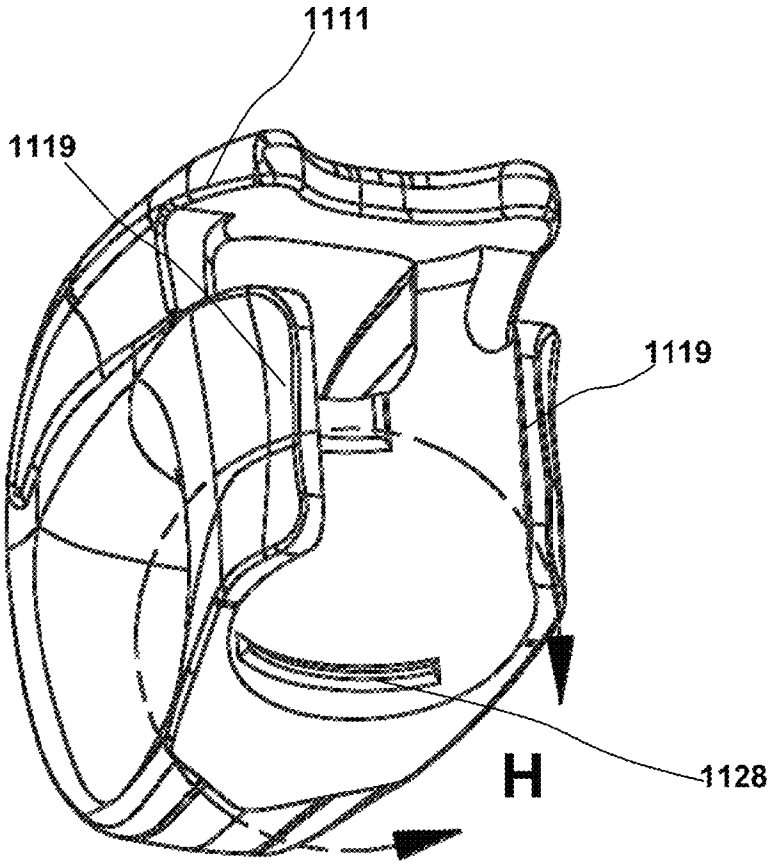
FIG. 56 is a lower rear perspective view of the body of the self-defense device of FIG. 50 showing an additional view of retention features for the assembly with a repellant spray container.
Figure 59:
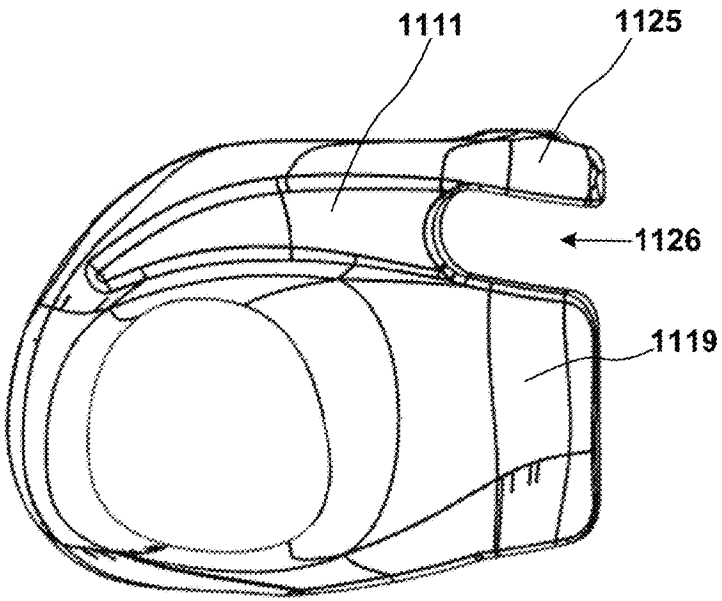
FIG. 59 is a side elevation view of the body of the self-defense device of FIG. 50.
Figure 58:
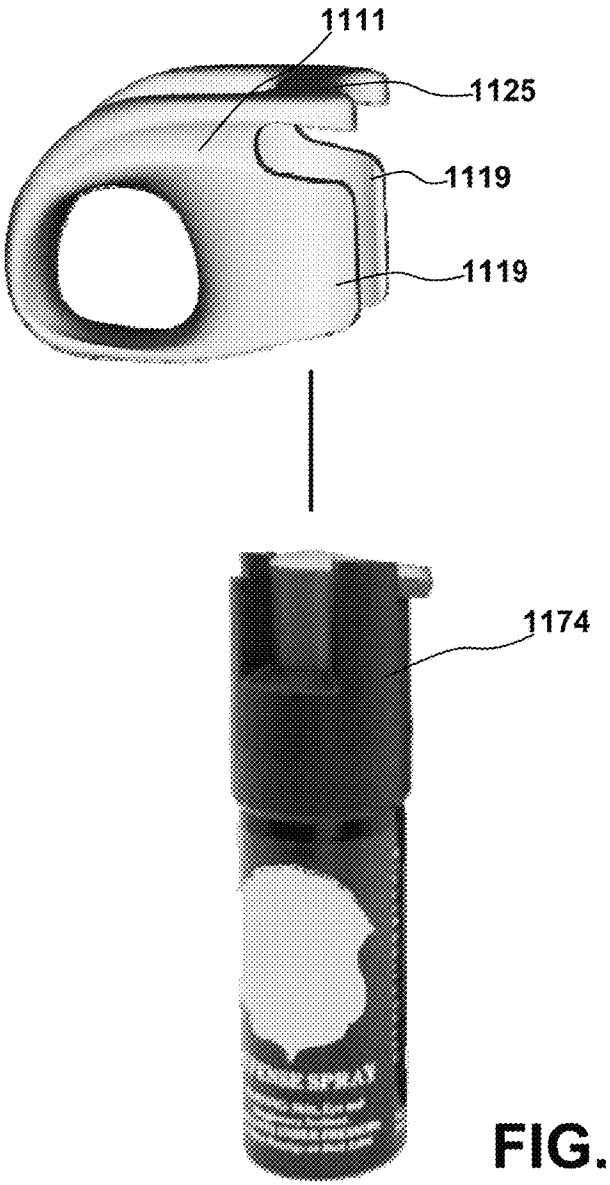
FIG. 58 is a side elevation view of the self-defense device of FIG. 50.
Figure 62:
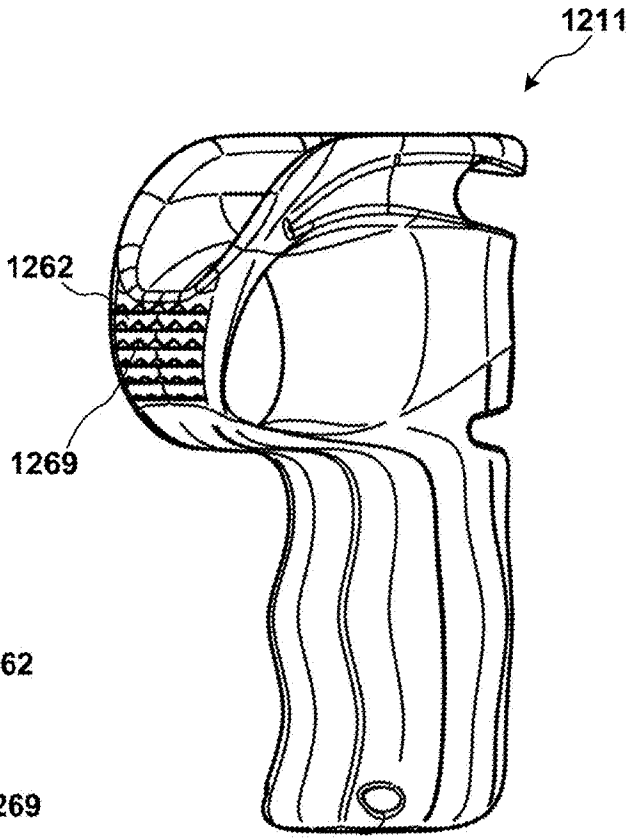
Figure 61:
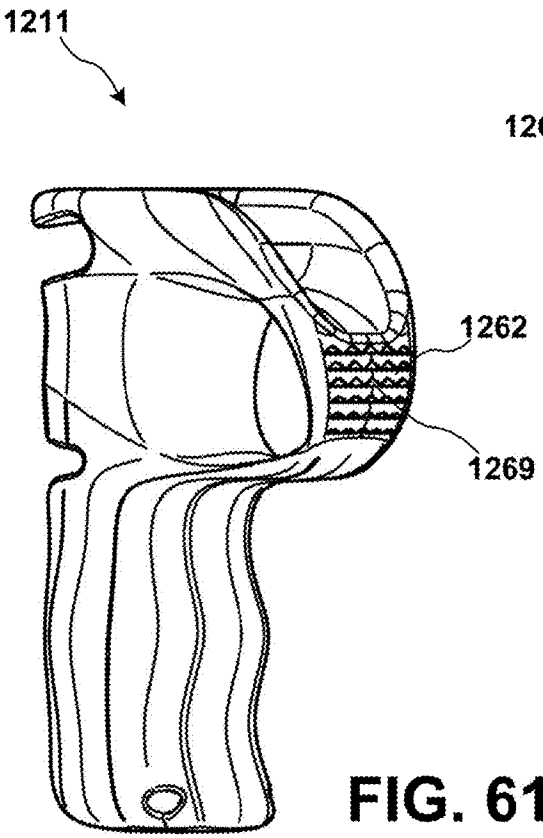
Figure 60:
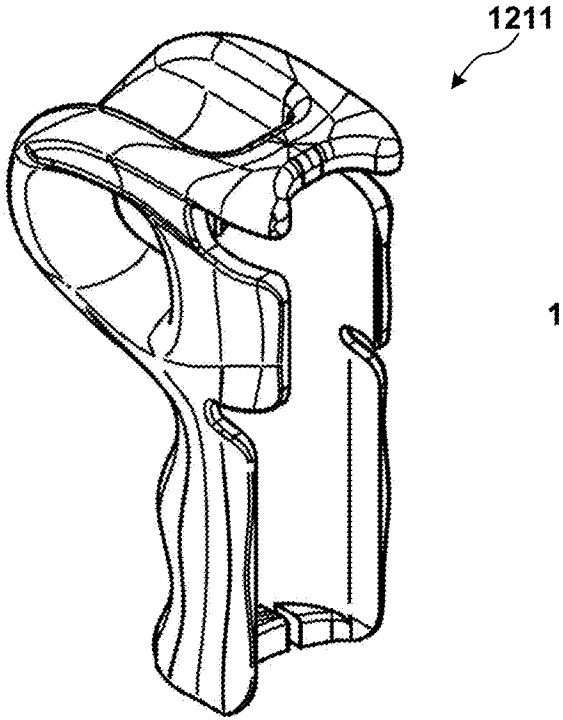
Figure 63:
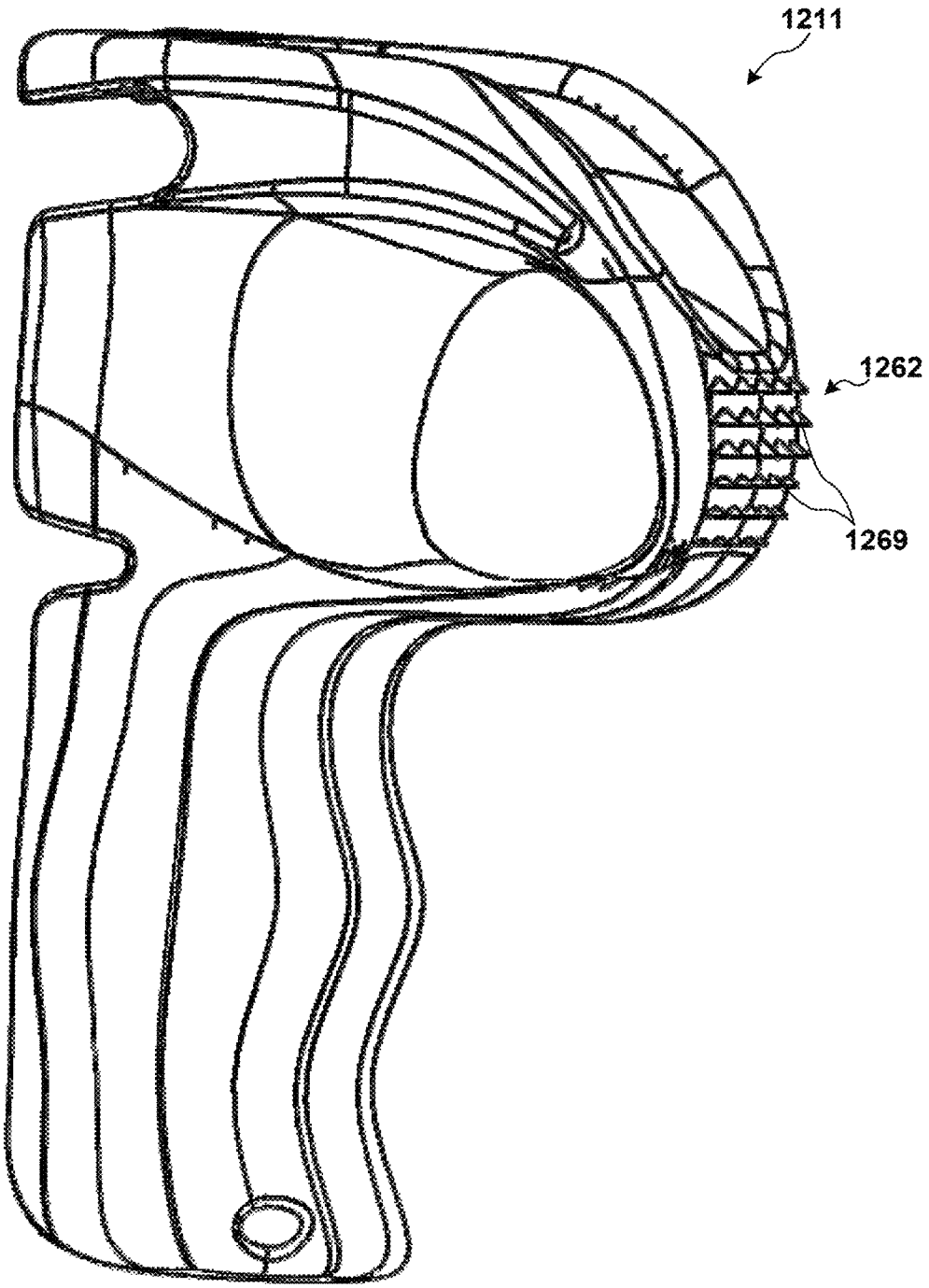
Figure 66:
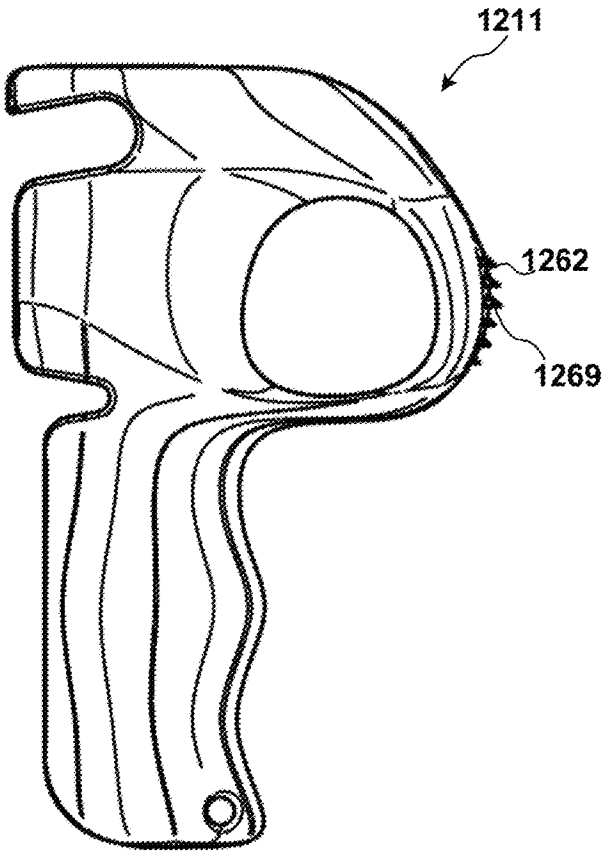
Figure 65:
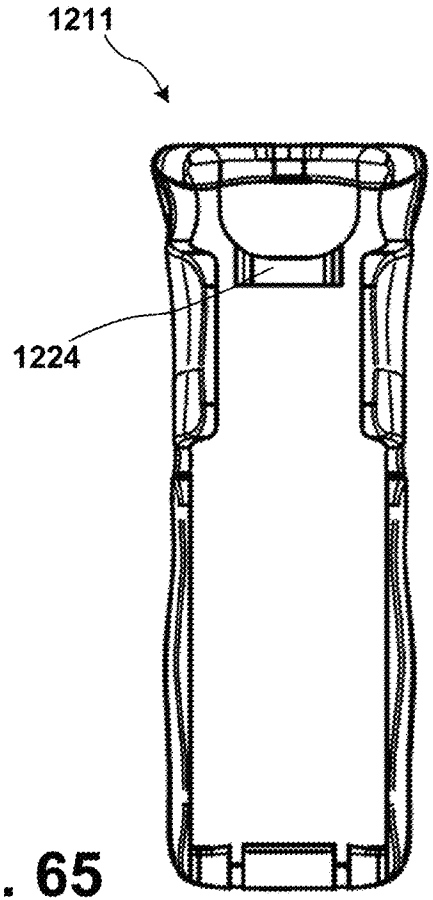
Figure 64:
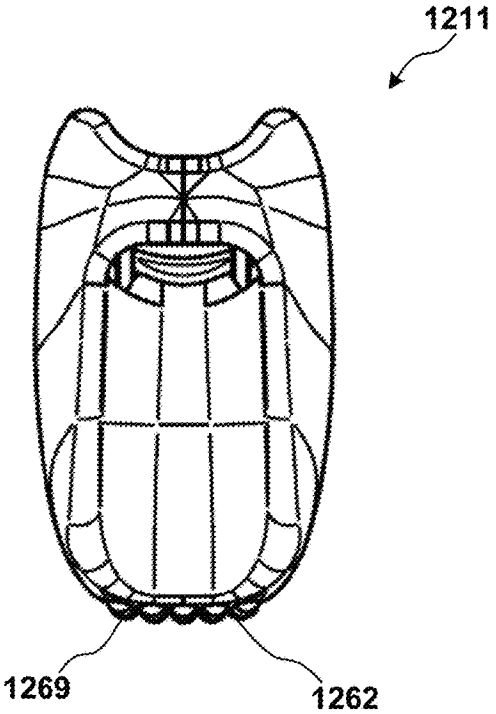
Figure 72:
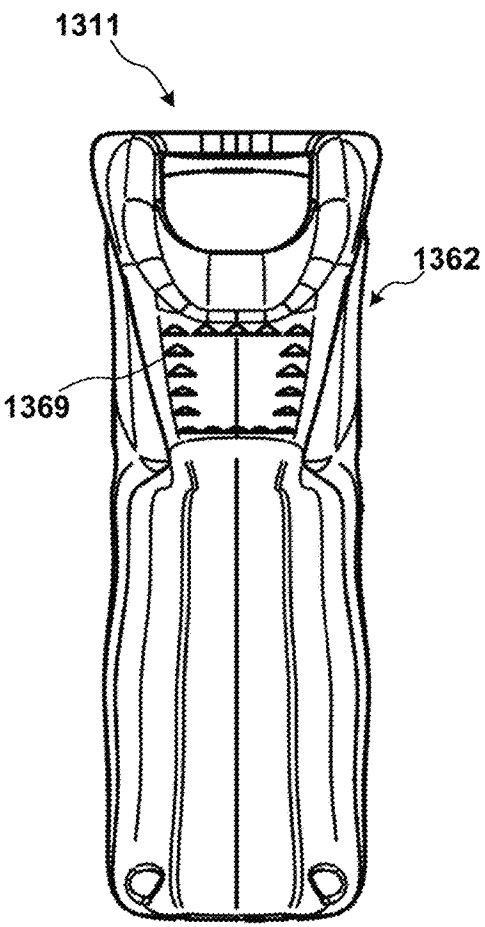
FIGS. 70 to 72 are perspective views of a yet another example rapid response self-defense and repellant spray device in accordance with aspects and features of inventive concepts shown and described herein including an additional option for a DNA collector.
Figure 71:
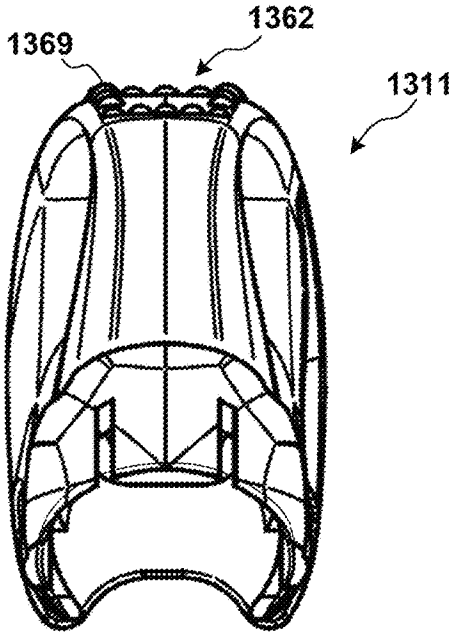
Figure 70:
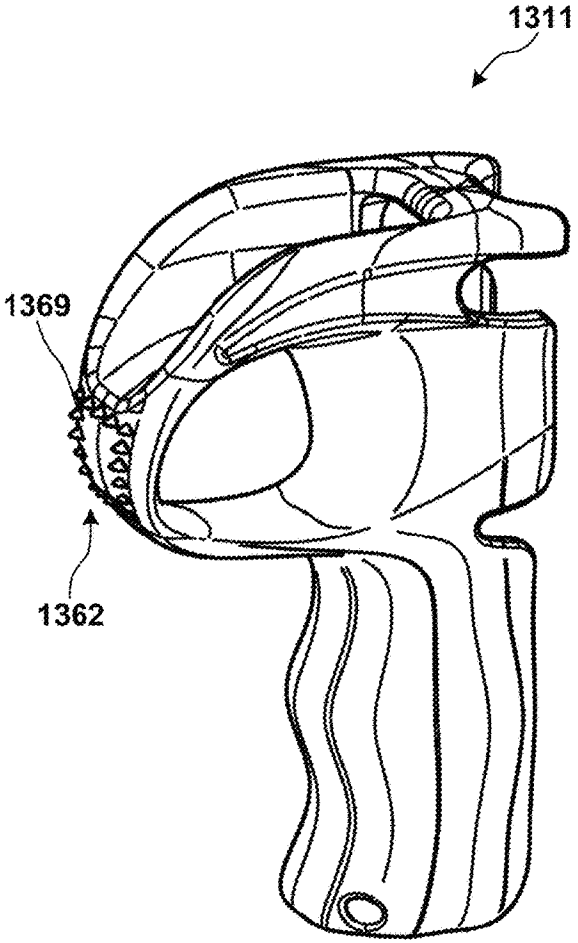

Referring now to FIG. 49 along with FIGS. 15-17, a method 4910 is generally shown for providing rapid and effective self-defense for a user. As shown, the method can generally include a step 4912 of determining size-related ranges of user parameters for a personal self-defense device for enabling rapid self-orientation and firm gripping for users including determining size-related index finger ranges and grip diameter ranges. As discussed above along with FIGS. 15-17, the size-related ranges can be determined based on a length, L, of the user's hand from the interface between the palm and wrist to the end of the middle finger. The inventors have determined that a firm grip can be provided via a grip diameter that is 15% to 40% of the length L of the user's hand and preferably 20% to 35% of the length L, and more preferably 20% to 25% of the length L. Alternatively, the size-related ranges can be determined by measuring the diameter, D, formed by the user forming an "O" shape with their fingers and thumb as shown in FIG. 17. Based on typical hand lengths, L, and "O" shaped diameters, D, ranges of self-defense devices 110 can be provided having grip diameters about 20% to 25% of the length of hands and/or for diameters, D, of most user.

Further, the size-related ranges can be determined based on the diameter of the user's index finger. As discussed above along with FIG. 15, the size-related ranges can be determined for finger openings 136 for most users, such as a finger opening diameter 137 about 1.5 times the diameter of the user's fingers. As an alternative, the grip diameter 122 can be determined for most users to be about two times the diameter of the user's index finger.

The method 4910 continues by configuring 4914 the self-defense device for the ranges of user parameters, which can include determining an arrangement for an orientation guide of the self-defense device enabling rapid identification via contact by a single finger of a user of an intended grip location and device orientation (e.g., diameter 137 of finger opening 136), and determining a secure grip for the self-defense device for a user according to the rapid identification via contact by the user (e.g., grip diameter 122 based on the index finger diameter and/or hand length, L, and/or "O" shaped diameter, D). The method can further include identifying 4916 a corresponding self-defense device 110 for ranges of index finger size parameters and grip diameter, determining 4918 an index finger size and/or grip diameter for a particular user. The method 4910 can include matching 4920 a rapid self-orientation personal self-defense device with the index finger size and the grip diameter of the particular user, and providing 4920 to the particular user the matched rapid self-orientation personal self-defense device.

Optionally, the method 4910 can include, or another method (not shown) can be provided that includes configuring a practice version of the self-defense device for each range of the user parameters. The practice kit can include an inert version of a self-defense device, such as self-defense device 110, which can include an inert repellant spray container 174. The inert repellant spray container 174 can include a visible spray lacking any repellant characteristics, such as a water-based, polymeric-based, glycerin-based fluid or the like. In some arrangements, the visible spray can be colored to enhance practice usage by the user. Further, a target (not shown) can be provided for use with practice versions of the self-defense device 110. Although self-defense device 110 is included along with description of method 4910 and practice methods and kit, it is understood that any defense device configuration and related implementations described herein can be used.

The method can further include forming a practice kit for the practice version of the self-defense kit (not shown), matching a practice version of the self-defense device for the particular user, and providing to the particular user the matched practice version of the self-defense device and the practice kit.

Referring now to FIGS. 50 to 59, yet another example of a self-defense device 1110 is shown, which includes the aspects and preferences of self-defense device 110, except with respect to the attachment of the repellant spray container 1174 with the body 1111, and corresponding changes for body 1111. Like numbers refer to like features. As shown, self-defense device 1110 is configured similar to self-defense device 110 for the upper portion of the device including finger opening 1136 and above, but relies upon the body of the repellant spray container 1174 for the lower half. The upper portion of the repellant spray container 1174 is configured to mate with and be retained by body 1111 in a similar or same matter as described above for self-defense device 110 including mating with an anti-rotation boss and being retain by a pair of flex retention arms 1119. However, body 111 further includes a retainer tab 1128 defined within the storage cavity 1118 that is configured to engage with a medial indentation 1176 formed along the body of the repellant spray container 1174.

As such, self-defense device 1110 can provide a body 1111 of reduced size, which can nonetheless provide benefits and advantages discussed above along with self-defense device 110, but in an even smaller container. For instance, self-defense device 1110 provide a self-defense device that the user can readily grip and properly orient and aim for accurate usage via feel without taking their eyes of a potential attacker and firmly grip. Although shown without having a DNA collector disposed on the tip portion, it is understood that a DNA collector or alternative DNA collector configurations can be included.

Referring now to FIGS. 60 to 66, a further self-defense body 1211 for a corresponding self-defense device is shown, which generally includes the same aspects and features as described along with self-defense device 110 and self-defense body 1211, except with respect to the DNA Collector 1262. As shown, DNA Collector 1262 can be configured as a textured surface 1262, such as a roughened surface, which can scratch, scrape or otherwise obtain DNA samples from an attacker during contact and retain the same. The example shown for DNA Collector 1262 includes an array of raised, angled rasp-like features 1269 having sharp edge surfaces, which can scrape exposed skin or other DNA samples from an attacked and retain such samples under the raised rasp-like features. It is understood that other types of DNA collector roughened surfaces can be used, and that other arrangements of rasp-like features 1269 or similar features can be used.

Figure 73:
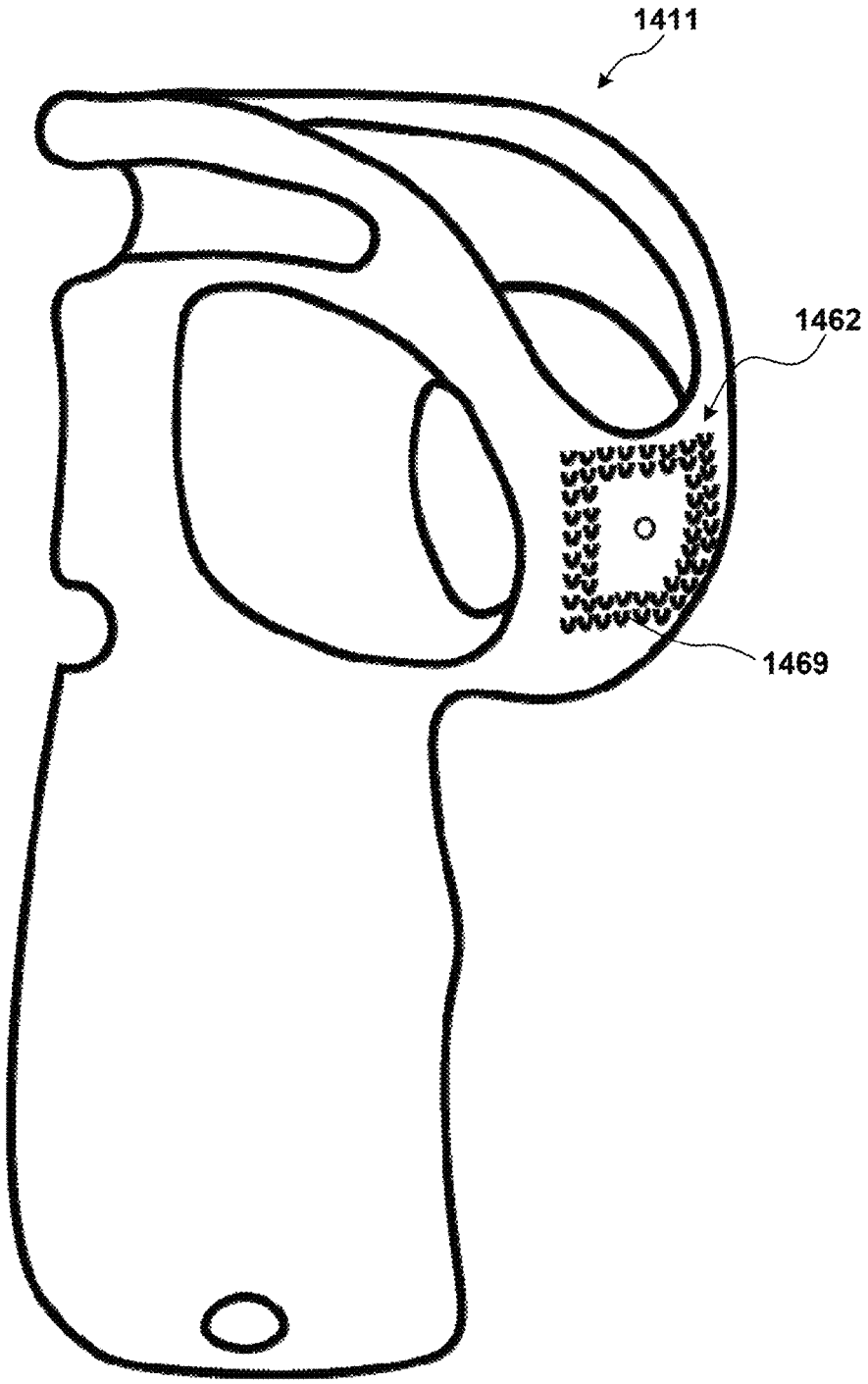
FIG. 73 is a perspective view of an additional example rapid response self-defense and repellant spray device including a further option for a DNA collector.

Referring now to FIGS. 67 to 73, additional self-defense device bodies 1311 and 1411 are shown, which include the aspects and preferences of self-defense body 1211 except pertaining to the DNA Collector arrangement options represented. As shown in FIGS. 67-72, a self-defense body 1311 is shown for a corresponding self-defense device, which includes a generally rectangular arrangement of rasp-like features 1369, which can reduce the likelihood of inadvertently catching against various objects while still functioning to capture DNA samples from an attacker. FIG. 73 shows a self-defense body 1411 having an arrangement of smaller rasp-like features 1469 along with at least one dimple that can help retain samples. It is understood that various types of raised or roughened features can be used in a different arrangements for obtaining DNA samples during contact with an attacker and retaining the same.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

What is claimed is:

1. A rapid-response self-defense device configured to self-orient and enable accurate aim when gripped by a user in a vertical usage position pointed toward an offender and away from the user, the self-defense device having a body comprising:

an upper region comprising:

an index finger loop formed through the upper region configured to have a horizontal orientation when gripped by the user in the vertical usage position;

a front portion;

a rear portion defining a portion of a storage cavity configured to retain a repellant spray container;

a spray channel defined through the upper region from the portion of a storage cavity to the front portion;

a top surface located above the index finger loop in a horizontal orientation when gripped by the user in the vertical usage position, the top surface extending a sight distance from the rear portion to the front portion, the top surface forming an extended sight-line providing quick sight alignment for aiming at a potential target; and a thumb support defined in the rear portion behind the spray channel for receiving a user's thumb when gripping the device in the vertical usage position; and a lower region below the upper region and extending downward from the upper region, the lower region comprising:

a grip handle configured to provide multi-finger grip about the handle when gripping the device in the vertical usage position;

wherein, the index finger loop, the thumb support, and the grip handle self-orient the device for self-defense in the user's hand, and the top surface extended sightline enables accurate aim when gripping the device in the vertical usage position.

2. The self-defense device of claim 1, wherein:

a rear portion of the grip handle is configured to engage a palm of the user to enhance self-orientation, user grip and control in the vertical usage position.

3. The self-defense device of claim 2, wherein the grip handle rear portion includes a rear portion of the repellant spray container when retained within the storage cavity.

4. The self-defense device of claim 1, wherein a forward portion of the grip handle defines at least one contour for a finger of a user's hand.

5. The self-defense device of claim 4, wherein the forward portion of the grip handle defines two contours configured for receiving a portion of a middle finger and a ring finger of the user's hand.

6. The self-defense device of claim 4, wherein the contoured grip handle has a grip diameter sized for the user.

7. The self-defense device of claim 4, wherein the grip handle defines a wrist strap connection feature at a lower portion of the grip handle.

8. The personal self-defense device according to claim 1, wherein the top surface extended sightline further comprises a base surface having an increasing downward slope in a forward direction configured for aiming at a potential target.

9. The self-defense device of claim 8, wherein the top surface extended sightline further comprises a pair of opposed side surfaces aligned with the base surface, spaced apart on each side of the base surface, and extending upward from the base surface.

10. The self-defense device of claim 1, wherein the thumb support is formed as a hood extending across a rear portion of the spray channel proximate a trigger for actuating release of repellant spray from the repellant spray container, the hood configured to prevent inadvertent finger obstruction of a spray from the device.

11. The self-defense device of claim 10, wherein the hood defines a concave indentation.

12. The self-defense device of claim 10, further comprising at least one side relief slot defined in the upper region configured to receive rotation of a trigger lock of the repellant spray container and prevent accidental discharge of repellant spray while the trigger lock is disposed within the at least one side relief slot.

13. The self-defense device of claim 12, wherein the at least one side relief slot is formed along a lateral portion of the hood.

14. The self-defense device of claim 1, further comprising:

an attacker contact formed at the front portion, the attacker contact having an outer surface configured to provide a defensive contact with the attacker and collect a DNA sample from the attacker during the defensive contact.

15. The self-defense device of claim 14, wherein:

an outer surface of the attacker contact has a curved shape and defines a collection dimple within the curved shape;

a rim portion of the collection dimple defines a sharp collection edge configured to scrape the DNA sample from the attacked during the defensive contact; and the dimple is configured to retain the DNA sample.

16. The self-defense device according to claim 15, wherein an outer surface of the contact feature has a texture configured to scrape the DNA sample from the attacker during the defensive contact.

17. The self-defense device of claim 16, wherein:

the texture includes one of: a knurled surface, a milled surface, a grooved surface, a furrowed surface, a roughened surface, a raised projections surface, and an irregular projections surface.

18. The self-defense device of claim 1, the top surface extended sightline further comprising:

a base surface for aiming at the potential target when in the use condition, the base surface disposed at or below a lower part of the spray channel; and a pair of opposed side surfaces aligned with the base surface, spaced apart on each side of the base surface, and extending upward from the base surface;

wherein the base surface and the upward extending side surfaces define the top surface extended sightline as an open top recessed channel.

19. The self-defense device of claim 18, wherein:

the base surface has an increasing downward slope in a forward direction away from the user in the vertical usage position;

the pair of opposed side surfaces have outboard diverging curvatures extending upward from the base surface; and the downward sloped base surface, the outboard diverging pair of opposed surfaces, and the open top arrangement of the define a diverging shaped configured at the potential attacker.

20. The self-defense device according to claim 1, wherein:

the index finger loop defines a single finger opening formed through the upper region without defining additional finger openings;

the single finger opening forms a closed loop;

the closed loop and the curved rear inner surface are configured to enhance rapid self-orienting and firm gripping of the personal self-defense device by the user; and the self-defense device forms a "P" shape configured to be gripped by the user similar to gripping a gun without provoking an offender.

* * * * *